US005562071A

United States Patent [19]

Urushihata et al.

[11] Patent Number: 5,562,071

[45] Date of Patent: Oct. 8, 1996

[54] ENGINE VALVE OPERATION TIMING CONTROL APPARATUS

[75] Inventors: Haruyuki Urushihata; Makoto Kondou, both of Kariya, Japan

[73] Assignee: Nippondenso Co., Ltd., Kariya City, Japan

[21] Appl. No.: 512,397

[22] Filed: Aug. 8, 1995

[30] Foreign Application Priority Data

Aug. 31, 1994 [JP] Japan ..... 6-230743

[51] Int. Cl.[6] ..... F01L 1/34

[52] U.S. Cl. ..... 123/90.15; 123/90.17; 123/90.31

[58] Field of Search ..... 123/90.15, 90.17, 123/90.31

[56] References Cited

U.S. PATENT DOCUMENTS

| | | | |
|---|---|---|---|
| 4,862,843 | 9/1989 | Kawamoto et al. | 123/90.17 |
| 4,928,640 | 5/1990 | van Vuuren et al. | 123/90.17 |
| 5,184,578 | 2/1993 | Quinn, Jr. et al. | 123/90.17 |
| 5,289,805 | 3/1994 | Quinn, Jr. et al. | 123/90.17 |
| 5,333,577 | 8/1994 | Shinojima | 123/90.17 |
| 5,363,817 | 11/1994 | Ikeda et al. | 123/90.17 |
| 5,400,747 | 3/1995 | Tabata et al. | 123/90.17 |
| 5,417,187 | 5/1995 | Meyer et al. | 123/90.17 |
| 5,469,818 | 11/1995 | Yoshioka et al. | 123/90.17 |

FOREIGN PATENT DOCUMENTS

| | | |
|---|---|---|
| 6-299813 | 10/1994 | Japan . |
| 2267583 | 12/1993 | United Kingdom . |

*Primary Examiner*—Weilun Lo

*Attorney, Agent, or Firm*—Cushman Darby & Cushman, L.L.P.

[57] ABSTRACT

An engine valve operation timing control apparatus having a learning control function determines whether both of an actual phase difference angle and a target value between a crankshaft and a camshaft are almost constant for a predetermined time. When both of the actual phase difference angle and the target value become almost constant for the predetermined time, a control value is learned. A controller outputs the learned value to driving means to find a control value thereafter based on the learned value. As a result, the learning means learns the control value in correspondence with a rate of change of the actual phase difference angle and the control value found by the controller compensates for a disturbance factor. The learning operation is updated every time the actual phase difference angle and the target value converge to a constant value and is repeated when the convergence state continues.

10 Claims, 18 Drawing Sheets

FIG. 9
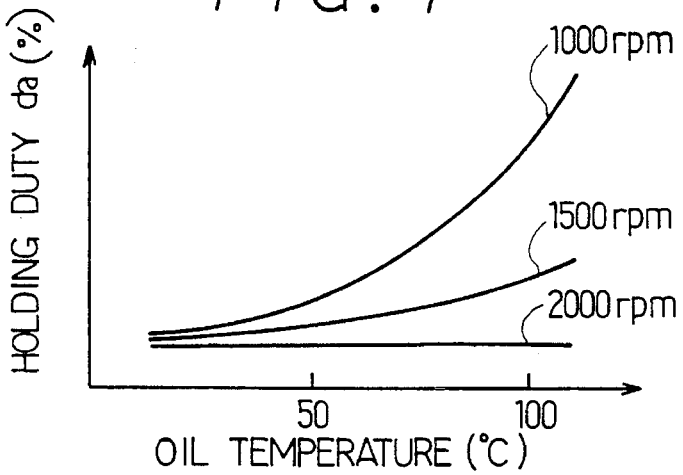
FIG. 10
MAP OF REF. HOLDING DUTY
| OIL TEMP. (°C) | REVOLUTION (rpm) 800 | 1200 | 1500 | 1800 |
|---|---|---|---|---|
| -20 | 50 | 50 | – | – |
| -10 | 50 | 50 | – | – |
| 0 | 50 | | | |
| 100 | 56 | 54 | 52 | 51 |
FIG. 11
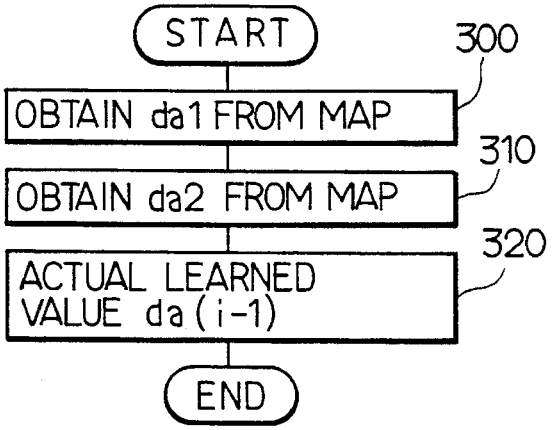

| No | REV. (rpm) | OIL TEMP. (°C) |
|---|---|---|
| 1 | 900 ~ 1100 | 80 ~ 100 |
| 2 | 1900 ~ 2100 | ↑ |
| 3 | 900 ~ 1100 | 40 ~ 60 |

CRANKSHAFT SIGNAL
T(sec)

CAM SHAFT SIGNAL #1
ADVANCE

CAM SHAFT SIGNAL #2
t (set)

ENGINE VALVE OPERATION TIMING CONTROL APPARATUS

CROSS-REFERENCE TO RELATED APPLICATION

This application is based on and claims priority from Japanese Patent Application No. 6-230743 filed on Aug. 31, 1994, the content of which is incorporated herein by reference.

BACKGROUND OF THE INVENTION

1. Field of the Invention

The present invention relates to an engine valve operation timing control apparatus for varying operation timing of intake and exhaust valves of an engine.

2. Description of Related Art

A valve operation timing control apparatus is used in a timing control system to advance or retard operation timing of intake and exhaust valves of an engine as disclosed, for example, in Japanese Patent Application Laid-Open No. Hei. 1-134010. The apparatus includes a phase control member, engaged between a crankshaft and a camshaft of the engine, which varies the operation timing of intake and exhaust valves driven by rotors on the camshaft by varying a rotational phase between both shafts by sliding the phase control member using two hydraulic systems.

However, the valve operation timing control apparatus described above has problems in that, because it requires two hydraulic systems to slide the phase control member, its structure is complicated and in that, because the phase angle between the crankshaft and the camshaft is varied simply by controlling the opening and closing of an electromagnetic valve, it is difficult to control a small angle of timing advance.

In order to solve the aforementioned problems, Japanese Patent Laid-Open Publication No. Hei. 6-299813 discloses a valve operation timing control apparatus whose structure is simplified by unifying the hydraulic systems of the valve operation timing control apparatus and which allows control of a small angle of timing advance by continuously controlling an opening of the electromagnetic valve of the hydraulic system and by adopting a feedback learning control feature for the control of the opening of the electromagnetic valve. This apparatus is arranged so that a control value which is output from a controller to the electromagnetic valve of the hydraulic system is stored in learning means when a target value of a rotational phase angle between the crankshaft and the camshaft is almost constant for a predetermined time, and the control value stored in the learning means is used as a learned value in generating a control value.

This apparatus assumes as its principle of learning that the rotational phase difference converges almost to a constant value when a state in which the target value of the rotational phase difference between both shafts is almost constant continues for a predetermined time and adopts as a condition of the learning that the target value is almost constant for the predetermined time. However, it is possible that, in the hydraulic unit, a leak increases due to a pressure drop and a drop in viscosity of control oil when the engine speed is low and oil temperature is high. In this case, a change speed of the rotational phase difference drops and an actual rotational phase difference (real phase difference angle) is still changing even if the target value is almost constant and the predetermined time has passed. If the predetermined time is prolonged in order to deal with this problem, the learning operation becomes difficult to perform, thereby reducing the learning frequency and preventing the system from dealing adequately with changes in operating conditions.

SUMMARY OF THE INVENTION

Accordingly, it is an object of the present invention to solve the aforementioned problems by providing an engine valve operation timing control apparatus which can carry out learning control reflecting an actual rotational phase difference (i.e., a real phase difference angle) and can control valve operation timing to following changes in operating conditions without reducing the learning frequency.

According to a first aspect of the present invention, an engine valve operation timing control apparatus includes a phase control mechanism, provided within a path for transmitting rotations of a crankshaft to a camshaft within an engine, for varying a rotational phase difference between the two shafts, driving means for driving the phase control mechanism, operating condition detecting means for detecting a plurality of operating conditions representing the operating condition of the engine, rotational phase difference detecting means for finding the actual phase difference angle between the two shafts based on the operating conditions detected by the operating condition detecting means, target value deciding means for deciding a target value of the rotational phase difference based on the quantities of operating condition detected by the operating condition detecting means and control means for generating a control value for causing the actual phase difference angle to coincide with the target value of the rotational phase difference and for outputting it to the driving means.

The control means may include first determining means for determining whether the actual phase difference angle is almost constant for a predetermined time or not, learning means for learning the control value when the actual phase difference angle becomes almost constant for the predetermined time and a controller for finding a control value thereafter based on the learned value.

The control means may also include second determining means for determining whether the target value is almost constant for a predetermined time and for causing the learning means to learn the control value when both of the actual phase difference angle and the target value become almost constant for the predetermined time.

The learning means may also learn the operating conditions detected by the operating condition detecting means in learning the control value and the control means may correct a learned value of the controlled value in accordance with changes of the operating conditions when the operating conditions change.

The predetermined time for determining whether the actual phase difference angle or the actual phase difference angle and the target value have converged almost to a constant value or not is set at a time of n pulses of pulse signals used in calculating the actual phase difference angle or at a time obtained by adding a certain time to this time of n pulses.

The learning means may learn an average value of the controlled values or a value obtained by smoothing the controlled values. The learning means may further learn the controlled value per area divided by the number of engine revolutions, oil temperature or water temperature. The learning means may further learn the controlled value only in n areas defined by the number of engine revolutions, oil temperature or water temperature, and use other areas by correcting the learned value by the operating conditions detected by the operating condition detecting means.

The control means may inhibit the learning by means of the learning means and corrects and uses the previous learned value right after start-up or when an oil temperature or water temperature is less than a predetermined temperature when the learned value is not corrected by the oil temperature.

The learning means need not use a newly learned value as a learned value as it is in updating the learned value, but may use a value obtained by adding 1/m of a difference between the previous learned value and a value learned this time to the previous value as a new learned value.

Further, the quantity of change of the learned value made in one time of learning may be limited.

Characteristics of a closed loop control system according to an aspect of the present invention will be explained here with reference to FIGS. 2*a* and 2*b*.

FIGS. 2*a* and 2*b* are block diagrams of a control system for feedback controlling a rotational phase angle, i.e. a camshaft advance value, by adjusting an opening of an electromagnetic valve in a hydraulic unit.

The reference numeral 106 in FIG. 2*a* denotes a PD controller including proportional and derivative functions but no integral operation, for example, and reference numeral 107 denotes an object to be controlled (e.g., a hydraulic unit) whose characteristics fluctuate due to manufacturing tolerances of the electromagnetic valve, oil temperature, oil pressure and number of engine revolutions, for example. In order to simplify the following explanation, the electromagnetic valve in FIG. 2*a* whose static characteristics are such that the characteristics in the vicinity of $u_1=0$ are linear is used. The reference character r denotes a target advance value in rotational phase angle, u a control value output from the controller 106, $u_1$ a control value determined by the above-mentioned static characteristics, and y a present camshaft advance value produced by the control operation. Assume here that the object to be controlled 107 contains integral elements and that the static characteristics between the quantity of control u and the camshaft advance speed fluctuates due to the manufacturing tolerances of the electromagnetic valve, oil temperature, oil pressure and number of engine revolutions. Accordingly, a value of d (i.e., a value of u when $u_1=0$) in FIG. 2*a* fluctuates. The value is assumed to be unknown.

When the static characteristics of the object to be controlled as described above are approximated by an inclination K, this control system may be represented as shown in FIG. 2*b* and the following relationships may be obtained. At this time, d described above may be assumed to be a disturbance added to an input section of the object to be controlled.

$$Y(s)=[K/s] * G(s) * [U(s)+D(s)] \quad (1)$$

$$U(s)=Gc(s) * E(s) \quad (2)$$

$$E(s)=R(s)-Y(s) \quad (3)$$

Then, if the target value r in Equation (3) is constant, Equation (4) may be derived from each expression above:

$$E(s)=[-K * G(s)] * D(s)/[s+K * Gc(s) * G(s.).] \quad (4)$$

If the disturbance d is assumed here as to be a step input of a magnitude $d_0$, it may be represented by $D(s)=d_o/s$. When it is substituted in Equation (4) and the Laplace transformation final-value theorem is applied, Equation (5) is derived:

$$E(\infty)=-d_0/Gc(0) \quad (5)$$

If the controller is a PD type, for example, its transfer function may be given by the following Equation (6). The gain of the controller becomes Gc(0)=Kc and Equation (5) becomes Equation (7):

$$Gc(s)=Kc * (1+T_D * S) \quad (6)$$

$$e(a\infty)=-d_0/Kc \quad (7)$$

Accordingly, if the target value r is constant, a deviation e converges to a constant value. Because the condition $u_1=1$ is fulfilled here when the advance value y is stationary, a control value of the controller at this time will be $u=d_0$. That is, the output value of the controller represents a magnitude of the disturbance d, and it may be used for the control thereafter by learning such an output value.

It is to be noted that according to the construction shown in FIG. 1, the controller of the control means contains no integrator and a hydraulic actuator which is the object to be controlled contains integral elements. Accordingly, as explained previously in connection with the characteristics of the closed loop control system, when the disturbance d exists in the hydraulic actuator, the disturbance d may be compensated by the control value u output from the controller when the actual phase difference angle y converges to a constant value because the target value r is a constant value.

Therefore, according to this aspect of the present invention, it is determined by the first determining means whether the actual phase difference angle is almost constant for the predetermined time. When the actual phase difference angle becomes almost constant for the predetermined time, the learning means learns the controlled value, and based on the learned value, the controller finds a controlled value thereafter. As a result, when the learning means 8 learns the controlled value, it learns in correspondence with the change speed of the actual phase difference angle, and the controlled value found by the controller compensates the disturbance d. Then, the above-mentioned learning operation is updated every time the actual phase difference angle converges to the constant value and if such a convergence state continues, the learning is repetitively carried out during that time.

The control means determines by the second determining means whether the target value is almost constant for the predetermined time and causes the learning means to learn the control value when both of the actual phase difference angle and the target value become almost constant for the predetermined time. Thereby, erroneous learning due to a delay in a response of the actuator (i.e., a phase control mechanism) or the like may be avoided and the accuracy of the controlled value learned by the learning means may be improved.

The learning means may learn the operating conditions detected by the operating condition detecting means, such as a number of engine revolutions, oil temperature, oil pressure and water temperature when learning the control value, and a learned value of the controlled value is corrected in accordance with changes of the operating conditions when the operating conditions change. It allows the learning control following to the changes of quantities of operating condition.

The predetermined time for determining whether the actual phase difference angle or the actual phase difference angle and the target value have converged almost to the constant value or not is set at a time of n pulses of pulse signals used in calculating the actual phase difference angle or at a time obtained by adding a certain time to this time of n pulses. This permits the system to deal with the increase/decrease of camshaft position detecting signals due to the changes of number of engine revolutions.

The learning means may learn an average value of the controlled values or a value obtained by smoothing the controlled values. Thereby, learning which is almost free from influence by dispersion of signals or the like may be carried out even. The learning means further may learn the controlled value per area divided by number of engine revolutions, oil temperature or water temperature. Thereby, a detailed learning control divided per number of engine revolutions, oil temperature or water temperature may be carried out.

The learning means further may learn the controlled value only in n areas defined by the number of engine revolutions, oil temperature or water temperature, and may use other areas by correcting the learned value by the operating conditions detected by the operating condition detecting means. Because the learned values of the areas not learned may be found by calculation, an effect of learning may be obtained even in a state in which there is less learning opportunity such as in the midst of a change in operating conditions.

The control means may inhibit the learning and correct and use a previously learned value right after start-up or when an oil temperature or water temperature is less than a predetermined temperature when the learned value is not corrected by the oil temperature. This permits the system to avoid carrying out a low accuracy learning when the number of engine revolutions is unstable.

The learning means need not use a newly learned value as a learned value as it is in updating the learned value, but may use a value obtained by adding 1/m of a difference between a previously learned value and a currently learned value to the previously learned value as a newly learned value. This permits the system to avoid erroneous learning in learning the controlled value. A quantity of change of the learned value made in one time of learning may be limited. This also permits the system to avoid erroneous learning.

BRIEF DESCRIPTION OF THE DRAWINGS

The above and other related objects and features of the present invention will be apparent from a reading of the following disclosure in conjunction with the accompanying drawings, in which:

FIG. 2*a* is a block diagram of a control system and FIG. 2*b* is a block diagram which is an approximation of FIG. 2*a;*

FIG. 5*a* shows a state in which a duty value is 100%, FIG. 5*b* shows a state in which it is 50% and FIG. 5*c* shows a state in which it is 0%;

FIG. 6*a* is a block diagram thereof and FIG. 6*b* is a graph showing static characteristics of the duty value and a camshaft advance speed;

FIG. 9 is a graph showing a relationship among holding duty value, oil temperature and number of engine revolutions in the preferred embodiment;

FIG. 10 is a map of holding duty values;

FIG. 11 is a flowchart explaining a case when a holding duty value is found from the map of holding duty values in FIG. 10;

FIG. 16*a* shows a relationship among the number of engine revolutions, oil temperature and learning areas and FIG. 16*b* explains a range of each learning area;

FIG. 21*a* shows a relationship between a camshaft advance position and time and FIG. 21*b* shows a relationship between the duty value and time;

FIG. 22*a* shows a relationship between the camshaft advance position and time and FIG. 22*b* shows a relationship between the duty value and time;

FIG. 23*a* shows a relationship between a camshaft advance position and time and FIG. 23*b* shows a relationship between the duty value and time; FIG. 24*a* shows a relationship between the camshaft advance position and time and FIG. 24*b* shows a relationship between the duty value and time.

DETAILED DESCRIPTION OF PREFERRED EMBODIMENTS

Figure 1:
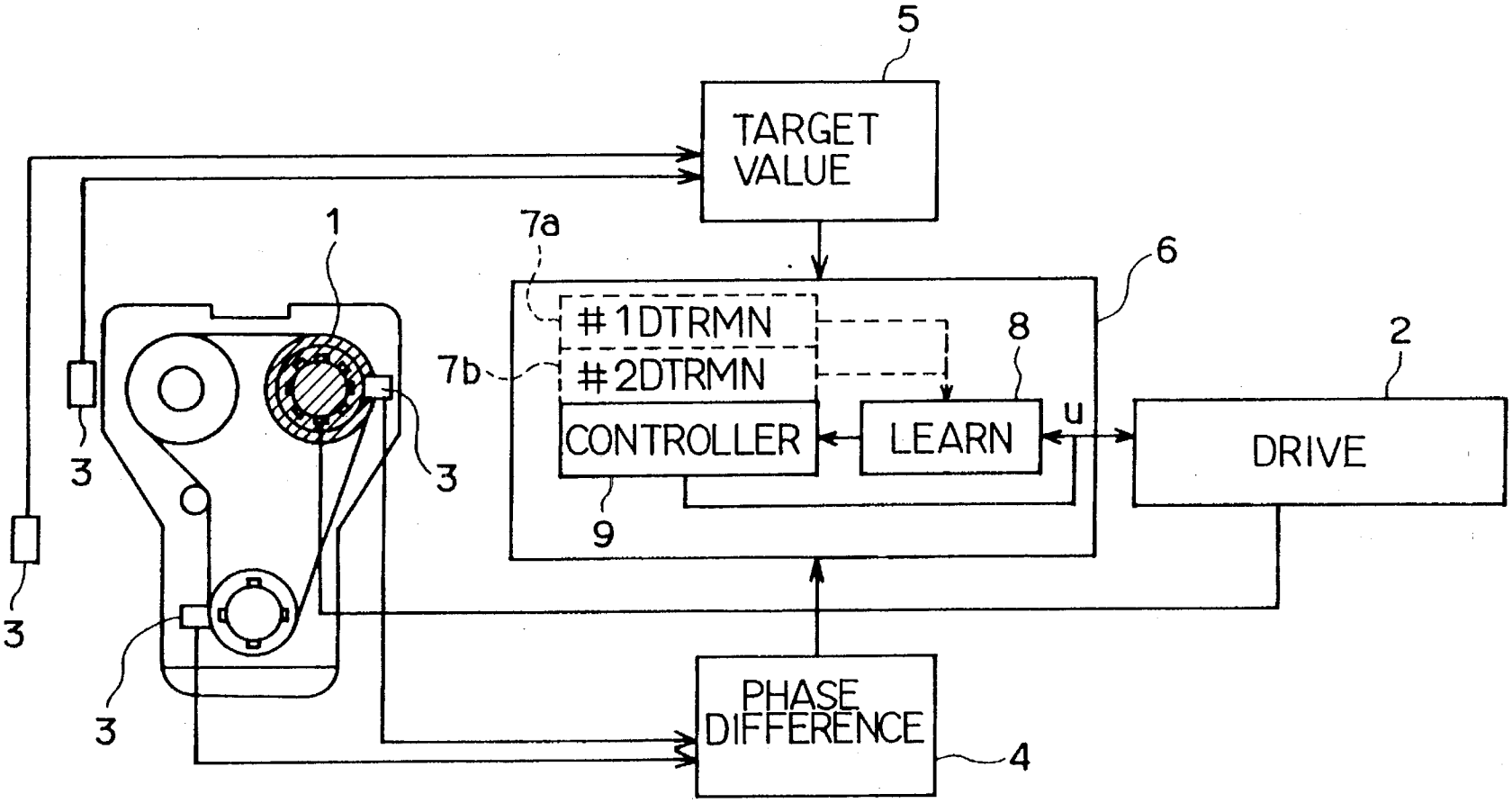
FIG. 1 is a block diagram showing one mode of a valve operation timing control apparatus according to a preferred embodiment of the present invention.
Figure 2A:
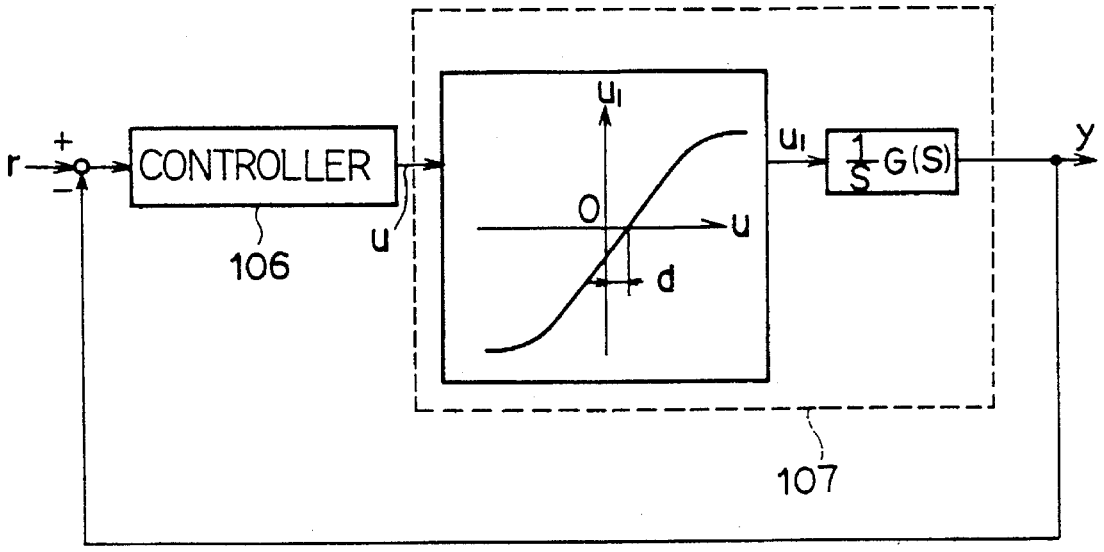
FIGS. 2*a* and 2*b* are block diagrams for explaining characteristics of a closed loop system used in the present invention, where
Figure 2B:
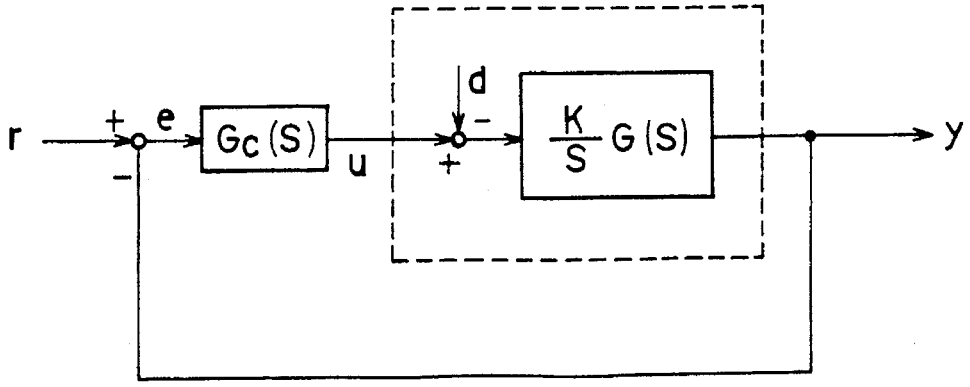
Figure 3:
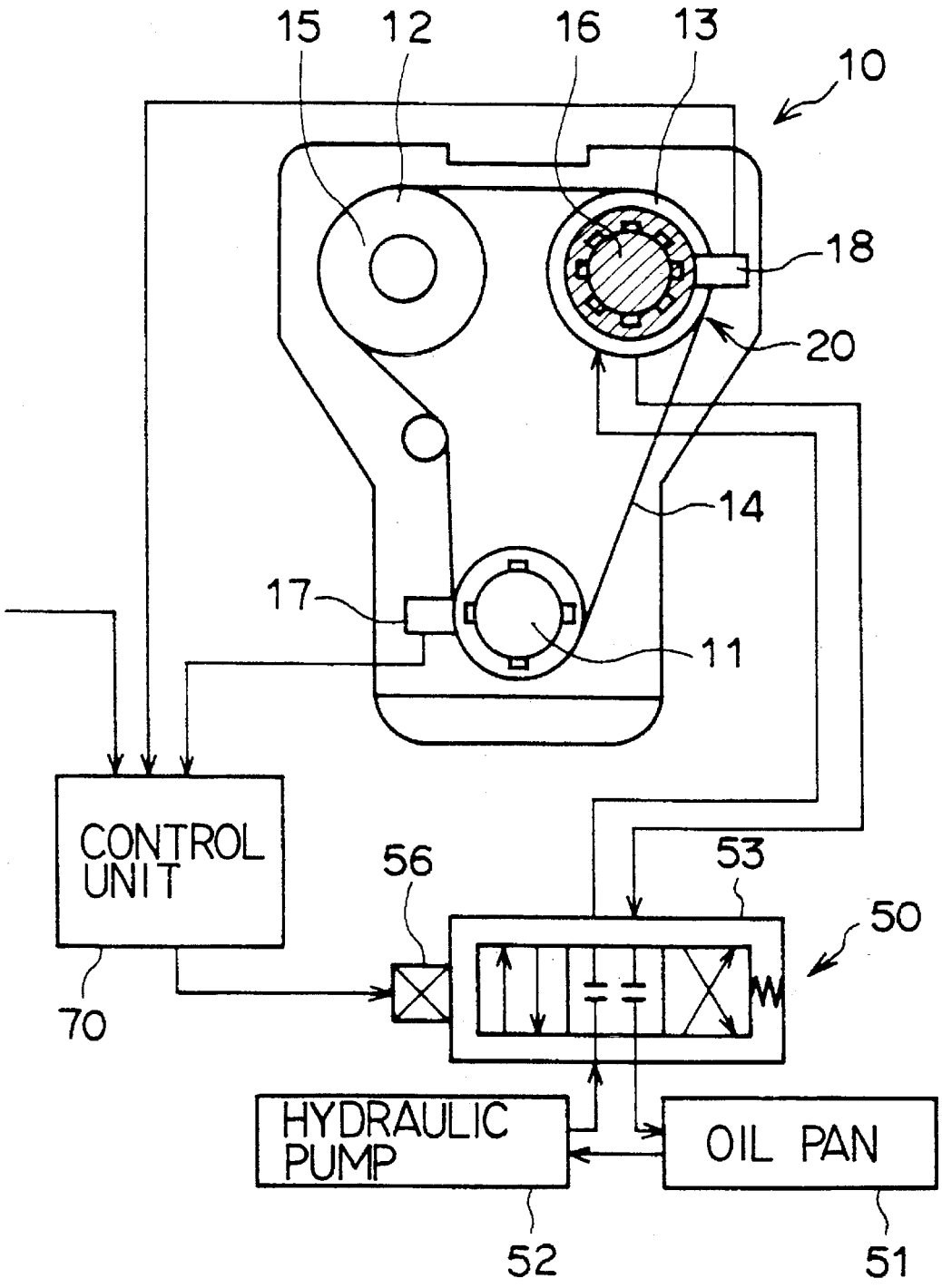
FIG. 3 is a schematic structural view illustrating a preferred embodiment of the valve operation timing control apparatus of the present invention.

A preferred embodiment of a valve operation timing control apparatus according to the present invention will be explained below with reference to the drawings. FIG. 3 is a structural view in which the invention is applied to a DOHC engine. In FIG. 3, reference numeral 10 denotes an engine, reference numeral 20 denotes a phase control mechanism (i.e., the hatched part) provided within the engine 10, reference numeral 50 denotes a hydraulic unit as driving means for driving the phase control mechanism 20, and reference numeral 70 denotes a control unit (i.e., control means) for determining an operating condition of the engine from signals of various sensors (i.e., operating condition detecting means) provided on the engine 10 and other devices to produce a control signal (i.e., a control value) and provide it to the hydraulic unit 50.

A timing chain 14 is passes around a crankshaft 11, a sprocket for exhaust valve 12 and a sprocket 13 for intake valve of the engine 10 to transmit rotations of the crankshaft 11 to each of camshafts 15 and 16. According to the present embodiment, the phase control mechanism 20 is provided within a path for transmitting the rotations between the sprocket 13 and the camshaft 16 to control an advance of the intake valve opening and closing timing by sliding the sprocket 13 in the direction of axis of rotation of the camshaft 16 to change a rotational phase between the sprocket 13 and the camshaft 16.

It is of course possible to control in the same manner by installing the phase control mechanism 20 on the side of the exhaust valve or by installing on both sides of the intake and exhaust valves.

A crank position sensor 17 is installed in the vicinity of the crankshaft 11 and a camshaft position sensor 18 is installed in the vicinity of the camshaft 16. As the above-mentioned sensors, an electromagnetic pick-up type sensor is used, for example. Each of these sensors 17 and 18 outputs pulse signals to the control unit 70 as each of the shafts 11 and 16 rotates. At this time, the sensor crank position sensor 17 generates more than N pulse signals per two rotations of the crankshaft 11 and the camshaft position sensor 18 generates more than N pulse signals per one rotation of the camshaft 16. The control unit 70 takes N pulse signals of the crank position sensor 17 while the crankshaft 11 rotates twice and takes N pulse signals of the camshaft position sensor 18 to measure a rotational phase difference angle 8 between the crankshaft 11 and the camshaft 16 based on those pulse signals. It is to be noted that the above-mentioned number of signals N taken out is set so that it becomes $N<720/\theta max$, where a maximum value of the rotational phase difference angle $\theta$ is $\theta max$ (CA).

Other than the pulse signals described above, the control unit 70 also takes in signals, representative of operating conditions, output from various sensors (i.e., operating condition detecting means) such as a number of engine revolutions, an intake air amount, a throttle opening, an idle signal, a temperature of cooling water and an oil temperature, and calculates a control value by learning control arithmetic operations which will be detailed later and outputs it to the hydraulic unit 50.

Figure 4:
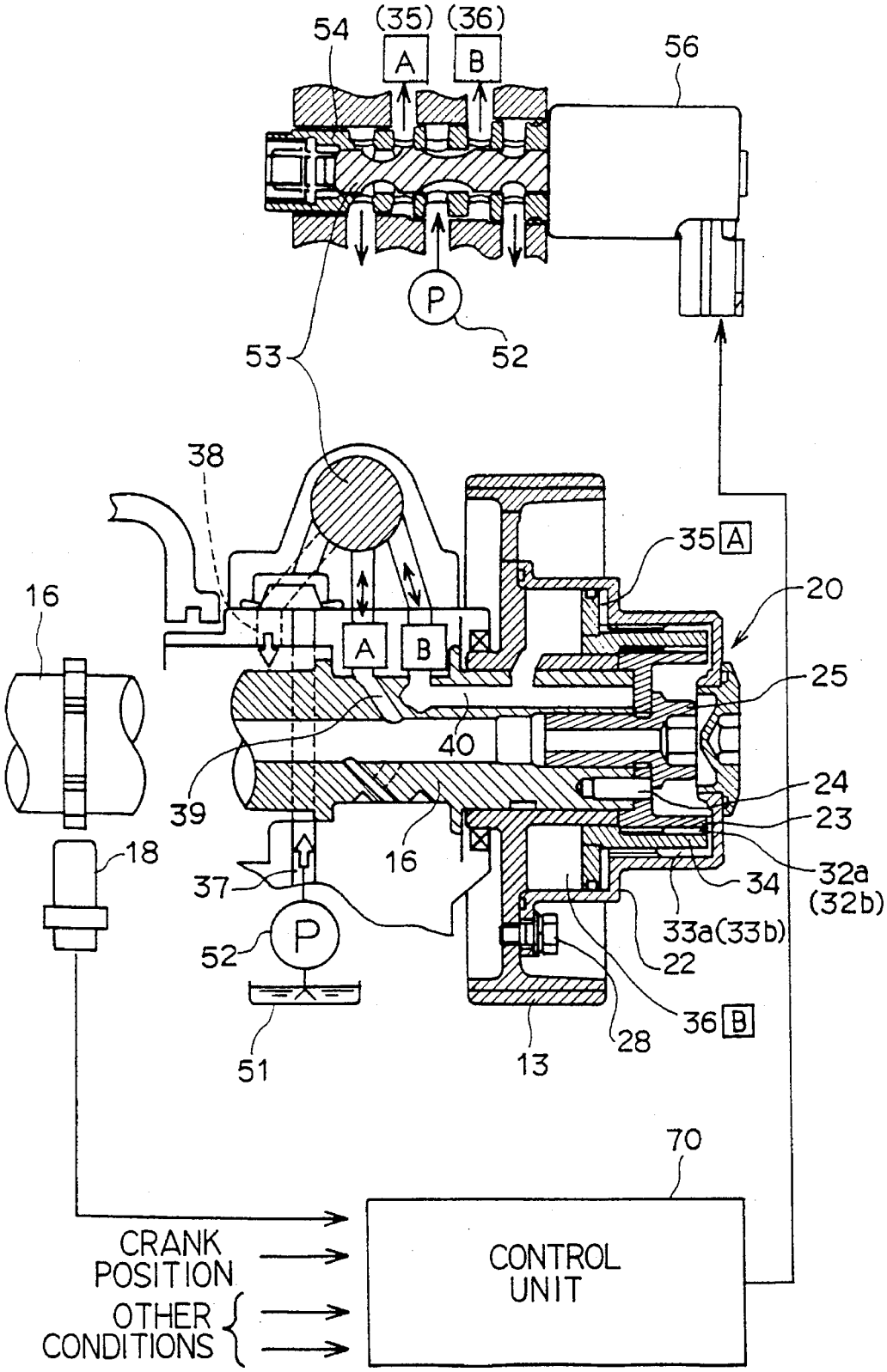
FIG. 4 is a partial cross-sectional view illustrating a phase control mechanism.

FIG. 4 is a partial cross-sectional view showing a state of connection of the phase control mechanism 20, sprocket 13 and camshaft 16. This construction will be described below in detail. The phase control mechanism 20 is assembled within a housing 22 fixed to the sprocket 13 by bolts 28. A camshaft sleeve 23 having an approximately cylindrical shape is fixed to the end of the camshaft 16 extending from the left side in the Figure by a pin 24 and a bolt 25. The sprocket 13 is engaged at the part where the camshaft sleeve 23 supports the camshaft 16. Although the sprocket 13 is blocked from moving in the direction of the axis of rotation thereof, it is allowed to slide in the rotational direction. The camshaft sleeve 23 and the camshaft 16 and the housing 22 and the sprocket 13 are fixed in one body, respectively.

An externally toothed helical spline 32*a* is formed on part of the outer periphery of the camshaft sleeve 23 and an internally toothed helical spline 33*a* is formed on part of the inner periphery of the housing 22. A cylinder 34 is fitted between the camshaft sleeve 23 and the housing 22 and each of the helical splines 32*a* and 33*a* engage, respectively, an internally toothed helical spline 32*b* formed on the inner periphery of the cylinder 34 and an externally toothed helical spline 33*b* formed on the outer periphery thereof. Thereby, the sleeve 23, housing 22 and cylinder 34 rotate in a body and rotation of the sprocket 13 is transmitted to the camshaft 16. Then, a thrust is generated at the engagement section when the cylinder 34 slides in the direction of the axis of rotation due to the helical spline engagement described above and the camshaft 16 slides in the rotational direction due to the thrust, varying a rotational phase between the sprocket 13 and the camshaft 16.

According to the present embodiment, the hydraulic unit 50 is used to slide the cylinder 34 and for that purpose, two hydraulic oil chambers 35 and 36 are provided inside the phase control mechanism 20. In FIG. 4, the right side is the hydraulic oil chamber 35 for an advancing operation and the left side is the hydraulic oil chamber 36 for a retarding operation. The cylinder 34 slides in the axial direction in response to a quantity of working fluid supplied to each of the hydraulic oil chambers 35 and 36. It is to be noted that an oil seal is appropriately applied at each area forming each of the hydraulic oil chambers 35 and 36.

The hydraulic unit 50 is provided with an oil pan 51 for storing the working fluid, a hydraulic pump 52 driven by the power of the engine, a spool valve 53 for distributing the working fluid pressure-fed from the hydraulic pump 52 and hydraulic paths for linking them. In FIG. 4, reference numeral 37 denotes a hydraulic path between the hydraulic pump 52 and the spool valve 53, reference numeral 38 denotes a hydraulic path between the spool valve 53 and a drain, reference numeral 39 denotes a hydraulic path between the spool valve 53 and the hydraulic oil chamber 35, and reference numeral 40 denotes a hydraulic path between the spool valve 53 and the hydraulic oil chamber 36.

Next, operation of the spool valve 53 will be explained with reference to FIGS. 5*a*, 5*b* and 5*c*. In the figures, the reference numeral 54 denotes a cylinder, reference numeral 55 denotes a spool which slides within the cylinder 54, reference numeral 56 denotes a linear solenoid for sliding the spool 55 in accordance with a control signal from the control unit 70, and reference numeral 57 denotes a spring for biasing the spool 55 in a direction opposite to the driving direction of the linear solenoid 56. Provided on the cylinder 54 are a working fluid feed port 58 communicating with the hydraulic pump 52 a working fluid exhaust port 59 communicating with the oil pan, a hydraulic port 60 communicating with the hydraulic oil chamber 35 and a hydraulic port 61 communicating with the hydraulic oil chamber 36.

The quantity of the working fluid in the hydraulic oil chambers 35 and 36 described above is increased or decreased as the spool 55 slides while changing an opening of each hydraulic port continuously. The opening is determined by a current value supplied to the linear solenoid 56. For that purpose, the control unit 70 generates the control signal from a duty value and outputs it to a current control circuit (not shown) to supply a current which corresponds to that duty value from the current control circuit to the linear solenoid 56.

Typical operating conditions of the spool valve 53 will be explained below using FIGS. 5*a*, 5*b* and 5*c*.

Figure 5A:
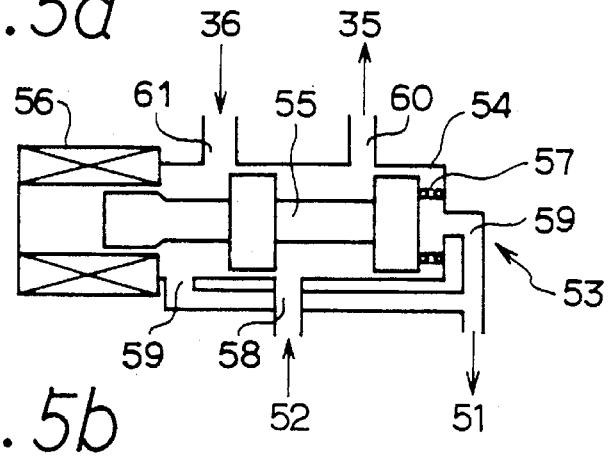
FIGS. 5*a*, 5*b* and 5*c* are partial cross-sectional views illustrating examples of each state of a spool valve in the control apparatus shown in FIG. 3, where

FIG. 5*a* shows a case where a duty value of a control signal of the control unit 70 is about 100%, wherein the spool 55 is driven to the right end of the cylinder 54 by the linear solenoid 56, the feed port 58 communicates with the hydraulic port 60, and the hydraulic port 61 communicates with the exhaust port 59. In this case, while the working fluid is supplied to the hydraulic oil chamber 35 via the hydraulic path 39, the working fluid is discharged from the hydraulic oil chamber 36. Thereby, the cylinder 34 shown in FIG. 4 moves in the right direction in the Figure and the phase of the camshaft 16 relative to the sprocket 13 advances, thus performing advancing control.

Figure 5B:
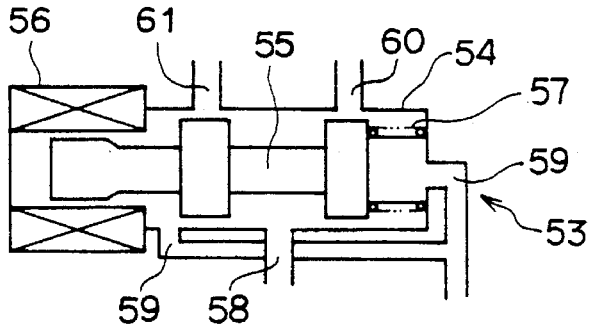

FIG. 5*b* shows a case where the duty value is about 50%, wherein the biasing force of the linear solenoid 56 is balanced with that of the spring 57, thus keeping the spool 55 at a position where it closes both hydraulic ports 60 and 61 and therefore, no working fluid is supplied or discharged to or from the hydraulic oil chambers 35 and 36. When there is no leakage of the working fluid from the hydraulic oil chambers 35 and 36, the cylinder 34 is maintained at this position and the phase between the sprocket 13 and the camshaft 16 is maintained as is.

Figure 5C:
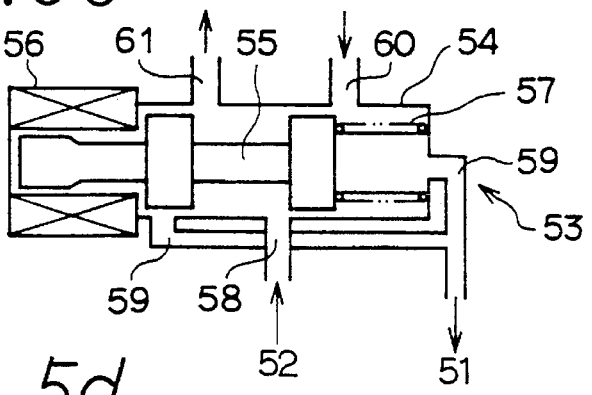
Figure 5D:
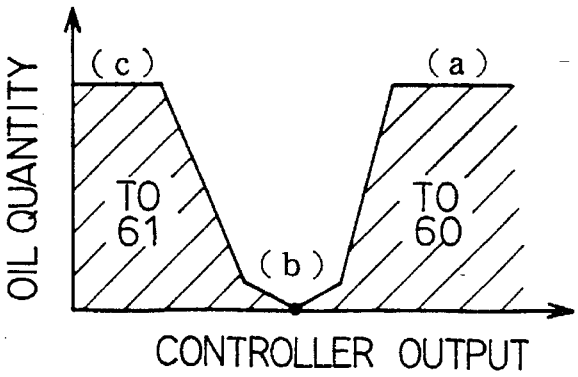
FIG. 5*d* is a graph showing a relationship between an output of a controller and a quantity of oil fed to each oil path in a valve apparatus.

FIG. 5*c* shows a case when the duty ratio is about 0%, wherein the spool 55 is biased to the left end of the cylinder 54 by the spring 57, the feed port 58 communicates with the hydraulic port 61, and the hydraulic port 60 communicates with the discharge port 59. In this case, because the working fluid is supplied to the hydraulic oil chamber 36 and the working fluid is discharged from the hydraulic oil chamber 35, the cylinder 34 shown in FIG. 4 moves in the left direction in the Figure and the phase of the camshaft 16 relative to the sprocket 13 is retarded, thus performing retarding control.

Figure 6A:
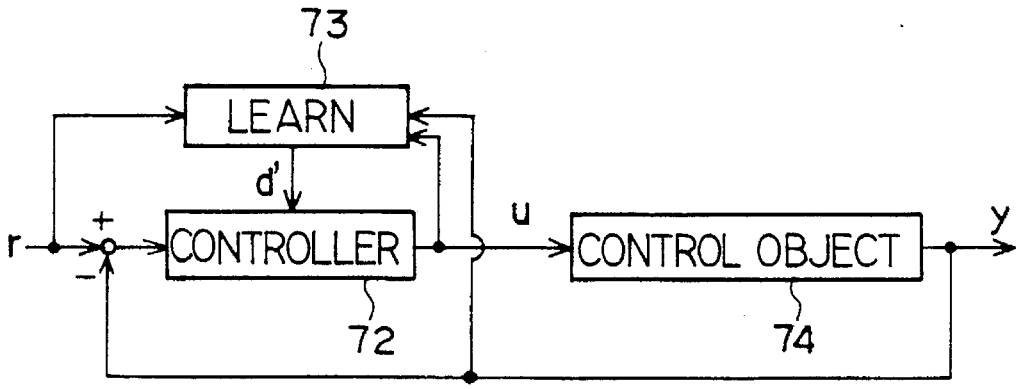
FIGS. 6*a* and 6*b* are diagrams showing a control system of the control apparatus in FIG. 3, where
Figure 6B:
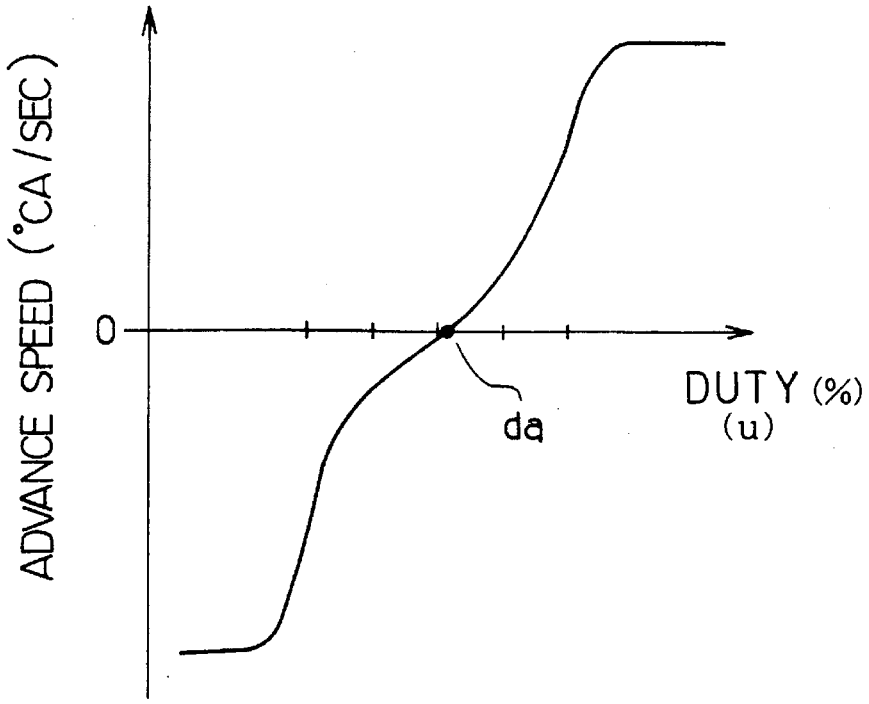

Next, control operations of the control unit 70 will be explained with reference to FIGS. 6*a* and 6*b*. FIG. 6*a* illustrates a control system implemented in the control unit 70. A controller 72 includes a PD controller to which a target camshaft advance angle r determined based on an operating condition of the engine 10, a present camshaft advance value y and a learned value d' from a learning circuit 73 (i.e., learning means) including a RAM are input. The controller 72 determines a control value u based on a flowchart described later and outputs it to an object to be controlled 74 which includes the hydraulic unit 50 and the phase control mechanism 20. At this time, the control value u is represented by a pulse width modulation signal and is supplied to the linear solenoid 56 via the current control circuit described above. Thereby, the working fluid in the hydraulic oil chambers 35 and 36 is adjusted and the camshaft 16 is displaced in the rotational direction thereof by an amount corresponding to the quantity of the working fluid. The camshaft advance value y at this time is detected from the object to be controlled 74. FIG. 6*b* shows a relationship between the control value u and a camshaft advance speed.

A duty value at a position of da in FIG. 6*b* is called a holding duty value. It is a duty value when the advance speed becomes "zero". In other words, this holding duty value da is a value for maintaining the present camshaft advance value. While the holding duty value da is set in advance by experiments or the like and is used in deciding the control value u described later, its value fluctuates due to a manufacturing tolerance or elapsed changes of the spool valve 53, a number of engine revolutions, a hydraulic value or an oil temperature.

Because the holding duty value da thus fluctuates due to the disturbing factors such as the manufacturing tolerance of the spool valve 53, oil temperature, number of engine revolutions and the like, it is necessary to compensate the holding duty value da in controlling the valve operation timing.

From this standpoint, the valve operation timing is controlled while learning and compensating the holding duty value da in the present embodiment. Details of the control will be explained below with reference to a flowchart shown in FIGS. 7 and 8.

In Step 100, each of operating condition signals of various sensors in the engine 10 is taken in at first to calculate the engine operating condition and the current camshaft advance value y(k) [actual phase difference angle] in Step 110 and to calculate a target camshaft advance value r(k) (i.e., a target value) based on the relevant operating conditions (hereinafter the current camshaft advance value is referred to as the "actual advance value", and the target camshaft advance value is referred to as the "target value") in Step 120. In the present embodiment, the process in Step 110 described above plays a role of rotational phase difference detecting means and the process in Step 120 plays a role of target value deciding means as recited in the appended claims.

After that, a deviation e(k) is calculated from the target value r(k) and the actual advance value y(k) in Step 130. When the present deviation e(k) is compared with zero in Step 140 and when $e(k) \geqq 0$, a control value u(k) is calculated in accordance with the following Equation (8) to advance the present camshaft advance value (Step 150):

$$u(k)=K_p * e(k)+K_D * [e(k)-e(k-1)]+da \quad (8)$$

When $e(k) \leqq 0$ on the other hand, the control value u(k) is calculated in accordance with the following Equation (9) to retard the present camshaft advance value (Step 160):

$$u(k)=K_p * e(k)+K_D * [e(k)-e(k-1)]+da \quad (9)$$

where $K_P$ and $K_D$ are feedback gains. Although the same gain values $K_P$ and $K_D$ are used in both equations in the present embodiment, the equations may be set up by different values in accordance with a load required for controlling the valve operation timing. The control value u(k) thus decided is output as the control signal to the linear solenoid 56 via the aforementioned current control circuit.

After calculating the control value u(k) in Step 150 or 160 described above, processing advances to Step 161 to determine whether a starter signal is ON or not, i.e. whether it is an engine cranking or start-up time or not. When it is the start-up time, processing advances to Step 163 to continue the valve operation timing control by using the holding duty value da used in a previous session as a holding duty value da(i) of this time, without carrying out a learning operation described below.

When it is not the start-up time on the other hand, the process advances to Step 162 to determine whether an oil temperature (or water temperature) exceeds a predetermined temperature T(°C.) or not. When the oil temperature (or water temperature)<T(°C.), no learning operation as described later is carried out, similar to the aforementioned case of the start-up time, and the valve operation timing control is continued by using the holding duty value da used in a previous session as the holding duty value da(i) of the current session in Step 163.

A case other than those described above, i.e. when it is not the start-up time and the oil temperature (or water temperature) exceeds the predetermined temperature T(°C.), the following learning operation is executed. At first, it is determined in Step 164 whether standards or references have been set up or not, i.e., whether a standard setting flag described later is ON or OFF. If no standard has been set up, the process advances to Step 166 to set up reference values (i.e., a target reference value ra and an advance value standard value ya) for determining whether the learning condition is satisfied or not, as follows:

1) Input the target value r(k) to the target standard value ra;

2) Input the actual advance value y(k) to the advance value reference value ya; and 3) Set the reference setting flag ON.

After setting up the reference values ra and ya for determining the fulfillment of the learning condition as described above, the process advances to Step 167 to input zero (i.e., reset) to a continuous time counter #1. After that, the process advances to Step 168 to turn OFF an in-learning flag for determining the fulfillment of the learning condition and to erase a stored value of the control value u(k) to end the control.

When it is determined in Step 164 that the standards have been set up, on the other hand, it is determined whether the in-learning flag is ON or not, i.e., the learning condition is satisfied or not. If the learning condition is not satisfied, the process advances to Step 170 to determine whether the target value r(k) is almost constant or not, i.e., whether a fluctuation width of the target value r(k) relative to the target reference value ra is within a small range r nor not, from the following equation:

$$|r(k)-ra| \leqq \Delta r$$

If the target value r(k) is not almost constant, the process advances to Step 166 described above to set the reference values ra and ya for determining whether the learning condition is satisfied or not. If it is determined that the target value r(k) is almost constant, the process advances to Step 180 to determine whether the actual advance angle y(k) is almost constant or not, i.e., whether a fluctuation width of y(k) relative to the advance value reference value ya is within a small range y or not, from the following equation:

$$|y(k)-ya| < \Delta y$$

If the actual advance value y(k) is not almost constant, the process advances to Step 166 described before to set the reference values ra and ya for determining the fulfillment of the learning condition. Accordingly, the reference values ra and ya for determining the fulfillment of the learning condition are set in this embodiment if either one of the target value r(k) and the actual advance value y(k) is not almost constant.

When both the target value r(k) and the actual advance value y(k) are determined to be almost constant in Steps 170 and 180, learning of the holding duty value da is executed in accordance with the following steps.

The present apparatus adapts characteristics of a closed loop control system in that a certain quantity of stationary deviation is generated when a disturbing factor exists in an object to be controlled to the learning of the holding duty value da, and monitors values of the target value r(k) and the actual advance value y(k) in controlling the valve timing to learn a control value u(k) as a new holding duty value da when those values are almost constant for a predetermined period of time.

In learning the holding duty value da, a continuous time $M_1$ during which both the target value r(k) and the actual advance value y(k) maintain almost a constant value is measured by the continuous time counter #1 in Step 190. The in-learning flag is turned ON assuming that the stationary state of the target value r(k) and the actual advance value y(k) can be determined only when the continuous time $M_1$ has reached the predetermined time $t_1$ (Step 200) and the learning operation is started (Step 210). On the other hand, when the continuous time $M_1$ has not reached the predetermined time $t_1$, the valve timing control is continued without carrying out the learning operation.

In the learning operation, when it becomes possible to determine the stationary state (Step 200), the control value u(k) is stored (Step 210), zero is input to a continuous time counter #2 (Step 215) and the valve operation timing control is continued. After that, a continuous time $M_2$ during which the actual advance value y(k) maintains an almost constant value is measured by the continuous time counter 2. When the continuous time $M_2$ reaches a predetermined time $t_2$, a decision result in Step 230 is determined to be "YES" and the process advances to Step 240, assuming that it has been confirmed that the actual advance value y(k) would not be changed by the stored control value u(k) to learn the newly learned value u(k) as a learned value as is. It is to be noted that the predetermined time t2 determined in Step 230 described above is a time greater than a response delay time of the actual advance value y(k) to the output control value u(k). When the newly learned value da(i) has been calculated in Step 240 described above, the process advances to Step 245 to turn OFF the reference setting flag to end the learning.

Because this learning operation is carried out during valve operation timing control, the fluctuation width of y(k) to the advance value reference value ya may become larger than Δy and may cause the learning to deviate after starting the learning operation. In such a case, the result of a decision in Step 220 is determined to be "NO" to stop the learning and to start again from the initial setting of the condition for starting the learning operation (Step 166).

The learning operation described above is finished when the holding duty value da has been learned and is started again from the setting of the reference values ra and ya for determining whether the learning condition is satisfied (Step 166). Then, after completing the updating of the learned value of the holding duty value da by the learning operation, a calculation of the control value u(k) is started immediately based on a new holding duty value da.

Figures 18A, 18B, 18C:
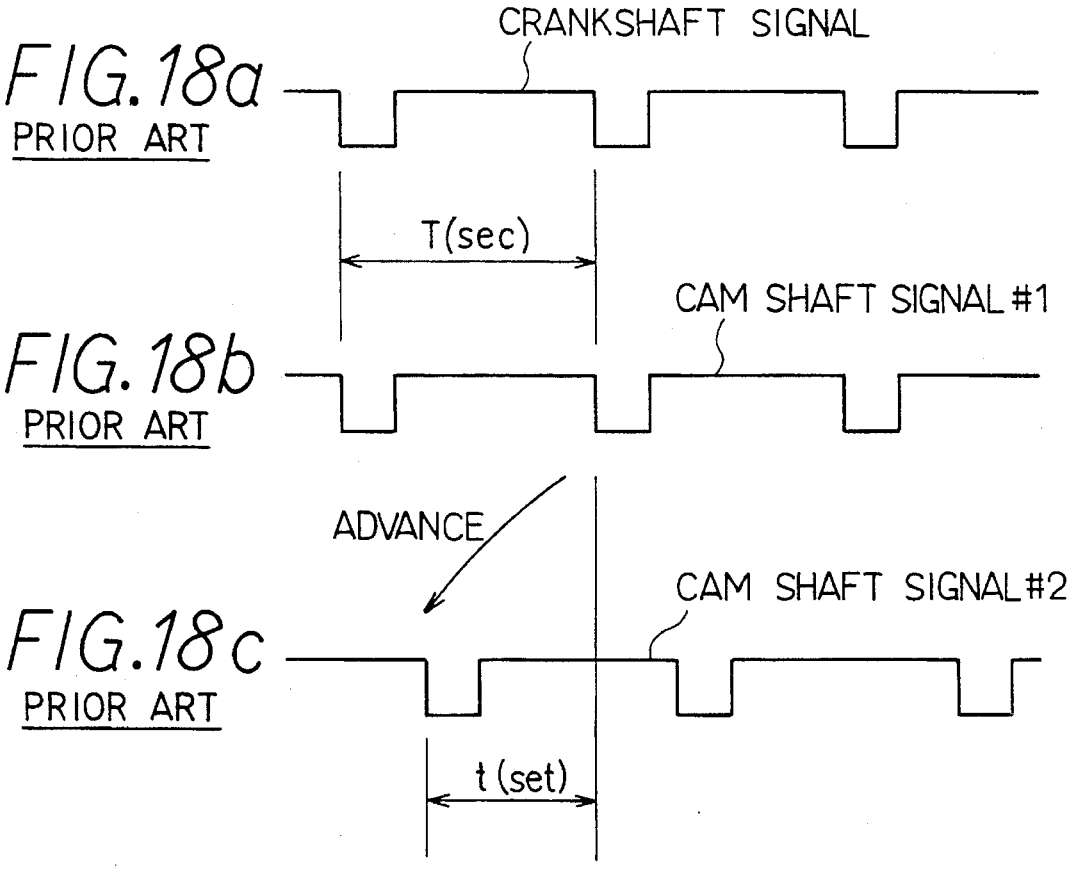
FIG. 18a PRIOR ART
FIG. 18b PRIOR ART
FIG. 18c PRIOR ART
FIG. 18*a* through 18*c* are graphs for explaining a relationship among a crank signal, camshaft signal and advance value according to the prior art.

It is to be noted that as a condition of the learning, the learning is not carried out when the number of engine revolutions is unstable immediately after start-up. While a calculation method as shown in FIGS. 18*a* through 18*c* is known in a control in which the advance value is calculated by signals output from the crank position sensor 17 and the camshaft position sensor 18, this method performs calculations based on an assumption that a number of revolutions is constant between the signals, and hence the error of the learning becomes large especially when the fluctuation of rotations is large such as when the engine is started. In the calculation method shown in FIGS. 18*a* through 18*c*, the advance value is calculated from the following equation when the camshaft signal #1 is in a most retarded state, the advance value is zero and the camshaft signal #2 is in an advanced state:

$$\text{advance value}=(t/T)\times 120$$

Another condition of avoiding the learning is a case when control in which a holding duty value cannot be corrected when an oil temperature changes is adopted and when the oil temperature or water temperature is below a predetermined value. This is because the learned value (i.e., holding duty value) changes depending on the operating conditions (e.g., oil temperature or number of engine revolutions) (See FIG. 9). Although it is possible to deal with the changes of the holding duty value to a certain degree by repeating the learning because the oil temperature will not rapidly change so much after warming-up, the oil temperature changes quickly and the holding duty value becomes obsolete soon thereafter even if the learning is carried out until the oil temperature is stabilized before completing the warm-up (set at 80° C. this time). Due to this, when there is less opportunity of learning, the holding duty value for an oil temperature of a very short time is used for the case when the oil temperature is stable after that, thus reducing the control precision. Accordingly, it becomes necessary to inhibit the learning when the oil temperature or water temperature is less than the predetermined temperature in a case other than the control of having a learned value per oil temperature or correcting learned value by oil temperature.

Figure 7:
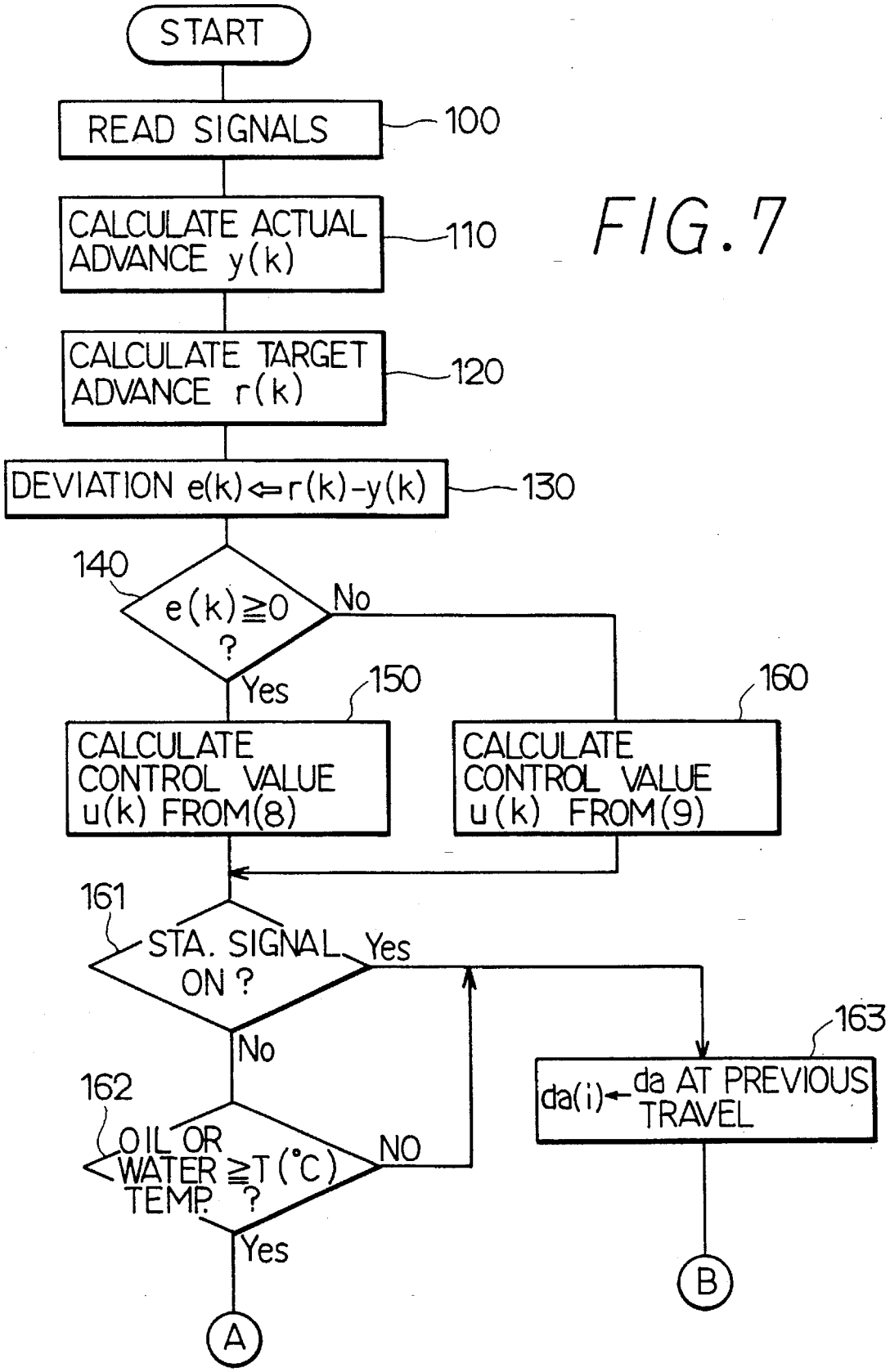
FIG. 7 is a flowchart of a learning operation executed by a control unit of the control apparatus in FIG. 3.

Considering such circumstances, according to the present embodiment, it is determined in Step 161 in FIG. 7 whether the starter signal is ON or not, i.e., whether it is the start-up time or not. If it is the start-up time, the process advances to Step 163 without carrying out the learning operation to use the holding duty value da calculated during a previous session (i.e., a learned value) as a holding duty value da(i) of the current session. If it is the start-up time on the other hand, the process advances to Step 162 to determine whether the oil temperature (or water temperature) exceeds the predetermined temperature T(°C.) or not. If the oil temperature (or water temperature)<T(°C.), no learning operation is carried out, similar to the case of the start-up time described above and the process advances to Step 163 to use the holding duty value da during a previous session (i.e., the learned value) as a holding duty value da(i) of the current session.

In a case when the learned value is obtained per number of revolutions as described below, the holding duty value da (i.e., the learned value) on the high rotation side (more than 2,000 rpm) during the previous travel is used for the whole rotation when the oil temperature is low. This is because the holding duty value da during the period when the oil temperature is low takes a value close to the holding duty value da on the high rotation side after warming-up, regardless of the number of revolutions (see FIG. 9).

It is to be noted that although the learning described before becomes necessary because the holding duty value da changes depending on a tolerance of dimensions of parts, number of engine revolutions and oil temperature, it is possible to estimate a variation of the holding duty value da relative to the changes of the number of engine revolutions and oil temperature. Accordingly, it becomes possible to correct the holding duty value da in response to the changes of the number of engine revolutions and oil temperature by learning the number of engine revolutions and oil temperature in advance at the same time as learning by the learning operation described above, before a learning opportunity comes when the operating conditions change (i.e., changes of number of revolutions and oil temperature).

A variation which embodies the above feature will be explained below with reference to FIGS. 9 through 11. A map for obtaining a reference holding duty value from the number of engine revolutions and oil temperature as shown in FIG. 10 is provided on the basis of characteristic curves showing a relationship among the holding duty value da, number of engine revolutions and oil temperature as shown in FIG. 9. This is done to correct and use actual learned values as described below, and uses a procedure as shown in FIG. 11 before the next learning opportunity comes. At first, a reference holding duty value da1 is found from the map in FIG. 10 on the basis of the number of engine revolutions and oil temperature during the learning in Step 300. Next, a reference holding duty value da2 is found from the map in FIG. 10 on the basis of the present number of engine revolutions and oil temperature in Step 310. After that, the actual learned value da(i−1) is corrected by the following equation to find a holding duty value da(i) of this time in Step 320:

$$da(i)=(da2-da1)+\text{actual learned value } da(i-1)$$

However, because the map in FIG. 10 is actually different for each vehicle due to an influence of dimensional tolerance of respective parts and the like, the precision of the corrected holding duty value da(i) drops more or less as compared to the actually learned value.

Further, although it is possible to perform correction using the water temperature instead of the oil temperature, the precision of the correction may drop more or less as compared to correction using the oil temperature since there is generally a difference between the oil temperature and the water temperature.

Although the predetermined times $t_1$ and $t_2$ have been used to confirm the learning condition in the series of processes related to the learning operation described above, it is possible to accommodate the increase and decrease of the signal from the camshaft position sensor 18 due to a change of number of engine revolutions by counting and using a number of input times of the pulse signals from the camshaft position sensor 18, instead of the predetermined times.

A variation which embodies this feature will be explained below with reference to FIG. 12. In the learning operation in FIG. 12, only steps which are different from those in the learning operation in FIG. 8 described above will have a reference symbol "a" affixed to the reference numeral thereof and be explained.

After setting the reference values ra and ya for determining whether the learning condition is satisfied in Step 166, the process advances to Step 167a to input zero (i.e., reset) to the sensor signal number counter #1. On the other hand, when both of the target value r(k) and the actual advance value y(k) are determined to be almost constant in Steps 170 and 180, the process advances to Step 190*a* to compare a count value $C_1$ of the sensor signal number counter #1 during the period when both the target value r(k) and the actual advance value y(k) maintain almost constant values (i.e., the number of input times of the pulse signals from the camshaft position sensor 18) with a predetermined number $S_1$ to continue the valve operation timing control without carrying out the learning operation when the count value $C_1$ has not reached the predetermined number $S_1$.

On the other hand, when it is determined in Step 190*a* that the count value C1 of the sensor signal number counter #1 has reached the predetermined number $S_1$, the in-learning flag is turned ON, assuming that the stationary state of the target value r(k) and the actual advance value y(k) can be determined (Step 200), the control value u(k) is stored (Step 210) and the sensor signal number counter #2 is reset (Step 215*a*).

After that, when the sensor signal number counter #2 counts the input signals during the period when the actual advance value y(k) maintains almost a constant value and the count value $C_2$ reaches a predetermined number $S_2$, the result of a decision in Step 230*a* is determined to be "YES", and the process advances to Step 240, assuming that it has been confirmed that the actual advance value y(k) would not be changed by the stored control value u(k), and the newly learned value u(k) is learned as a learned value as is.

It is to be noted that a time for confirming the learning condition varies depending on the number of engine revolutions in the present embodiment. Accordingly, an optimum use is to use an input signal counting method in the stationary determination, before the control value is stored, in which the accuracy of the number of input signals (i.e., the number of advance values ) is maintained in combination with a time determination method in confirming that the advance value will not be changed by the stored control value (see Steps 230*a* through 240) because the influence of time is great.

A variation which embodies the above feature will be explained below with reference to FIG. 13. Here, the continuous time counter #2 used in the learning operation in FIG. 8 and the sensor signal number counter #1 used in the learning operation in FIG. 12 are combined. That is, after setting the reference values ra and ya for determining whether the learning condition is satisfied in Step 166, the process advances to Step 167, similar to the learning operation in FIG. 8, to input zero (reset) to the sensor signal number counter #1. On the other hand, when both the target value r(k) and the actual advance value y(k) are determined to be almost constant in Steps 170 and 180, the process advances to Step 190 to measure a continuous time during which both the target value r(k) and the actual advance value y(k) maintain almost constant values using the sensor signal number counter #1 similar to the learning operation in FIG. 8. Then, only when the count value $C_1$ of the sensor signal number in the continuous time has reached the predetermined number $S_1$, the in-learning flag is turned ON assuming that the stationary state of the target value r(k) and the actual advance value y(k) can be determined (Step 200), the control value u(k) is stored (Step 210) and the continuous time counter #2 is reset (Step 215).

Figure 8:
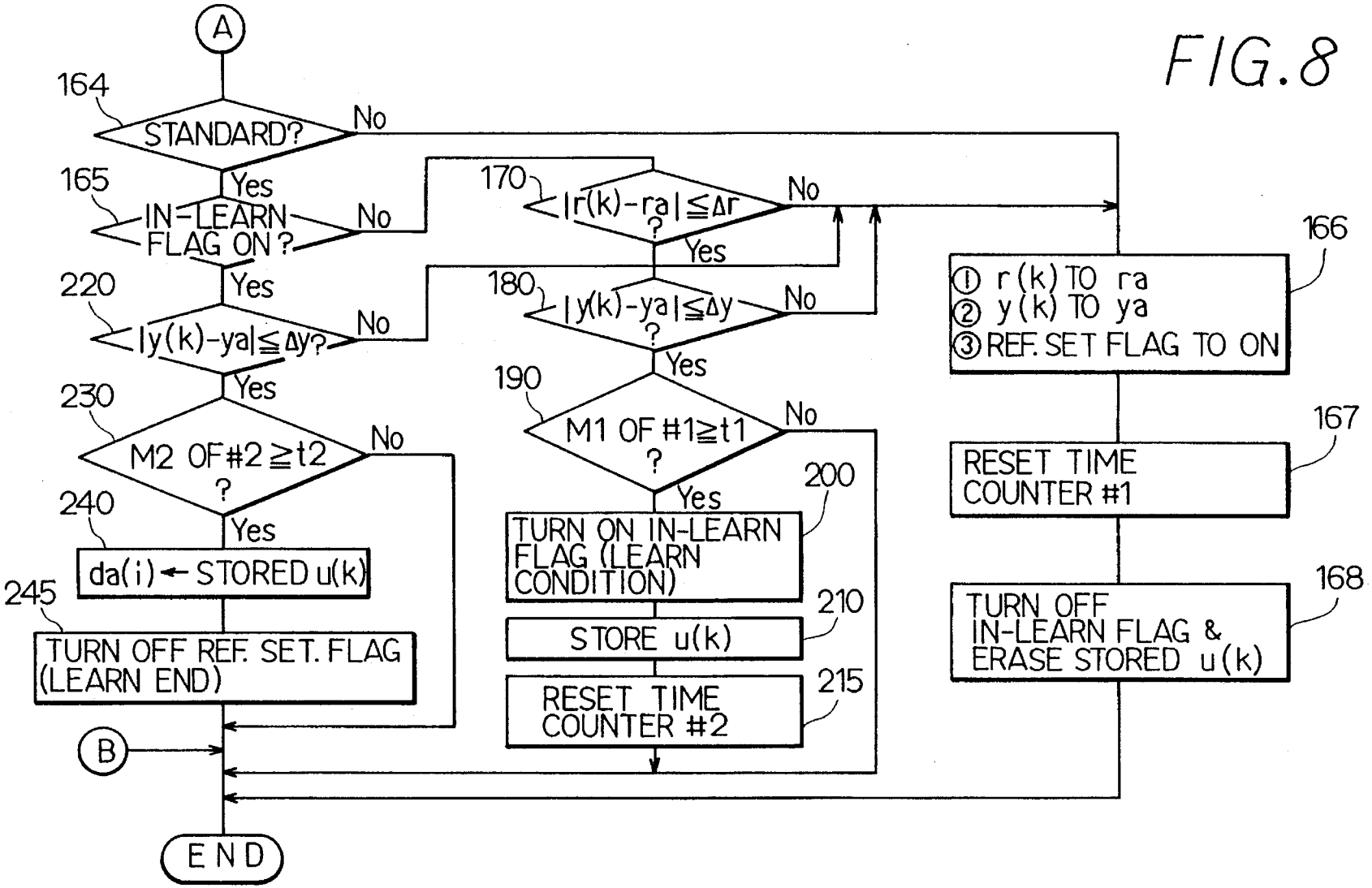
FIG. 8 is a flowchart of the learning operation continued from FIG. 7.

After that, when the continuous time counter #2 measures the continuous time and the continuous time $M_2$ reaches the predetermined time $t_2$ during the period when the actual advance value y(k) maintains almost the constant value similar to the learning operation in FIG. 8, the result of a decision in Step 230 is determined to be "YES" and processing advances to Step 240, assuming that it has been confirmed that the actual advance value y(k) would not be changed by the stored control value u(k), and the newly learned value u(k) is learned as a learned value as it is.

Because the response of the advance value to the control value changes depending on the number of engine revolutions and oil temperature, an operational area in which the learning accuracy drops is created if the determination time and number of determined signals are fixed. Accordingly, the learning accuracy may be maintained by changing the determination time or the input number of determined signals by the number of engine revolutions and oil temperature.

Figure 12:
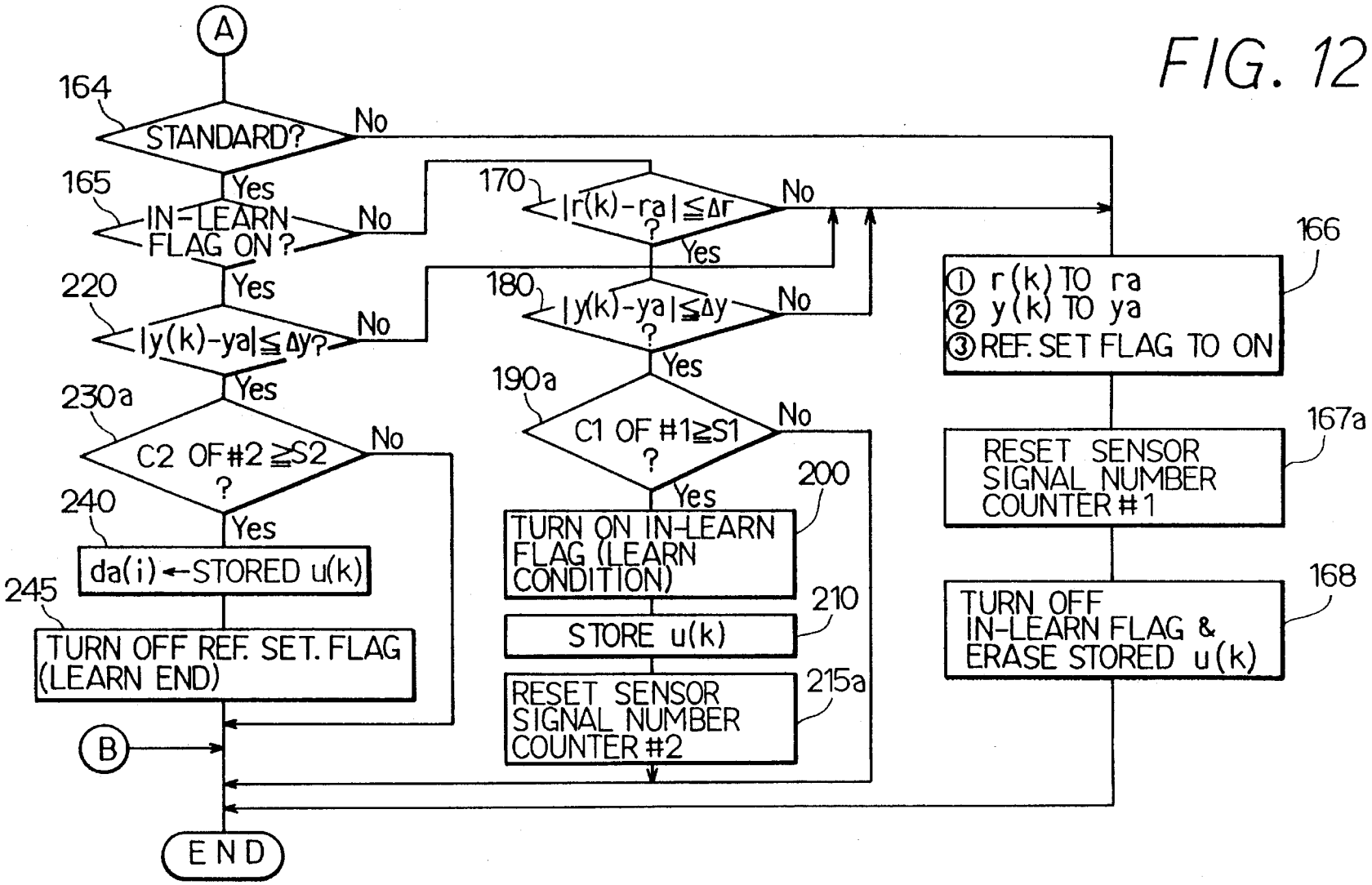
FIG. 12 is a flowchart showing a second example of the learning operation in the preferred embodiment.
Figure 13:
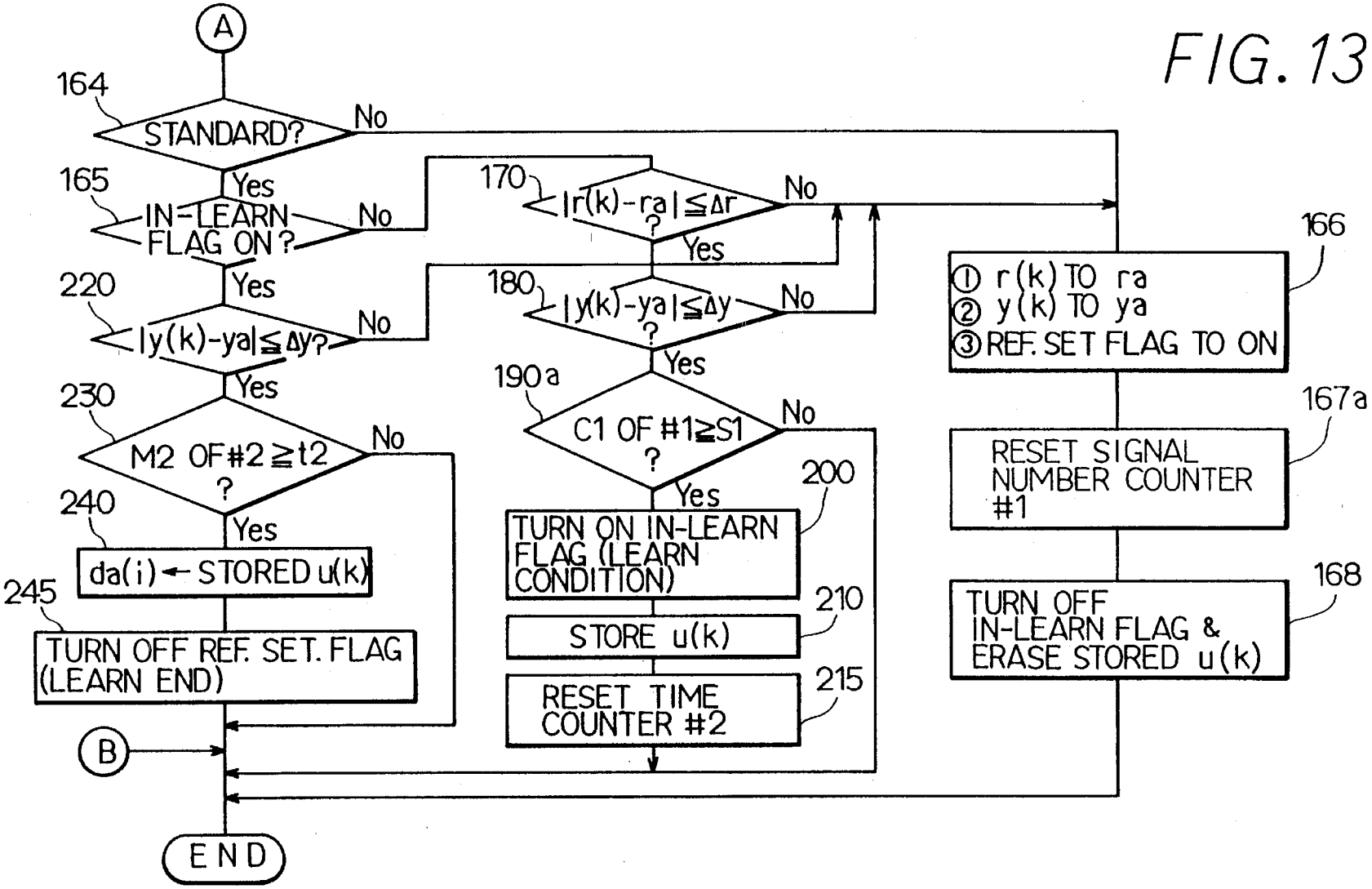
FIG. 13 is a flowchart showing a third example of the learning operation in the preferred embodiment.

Although the control value when the condition is satisfied has been learned by unmodified values in Step 240 in each learning operation of FIGS. 8, 12 and 13, a learning which is hardly influenced by dispersion of signals or the like can be implemented by adopting a smoothed value, e.g., a 1/n averaged value or an average value during the time t1 for determining the fulfillment of the learning condition. Because the control value is influenced by the dispersion of both the advance value and target value which are the basis of the calculation, its dispersion is apt to become large as compared with other values (e.g., target value and advance value).

Figure 14:
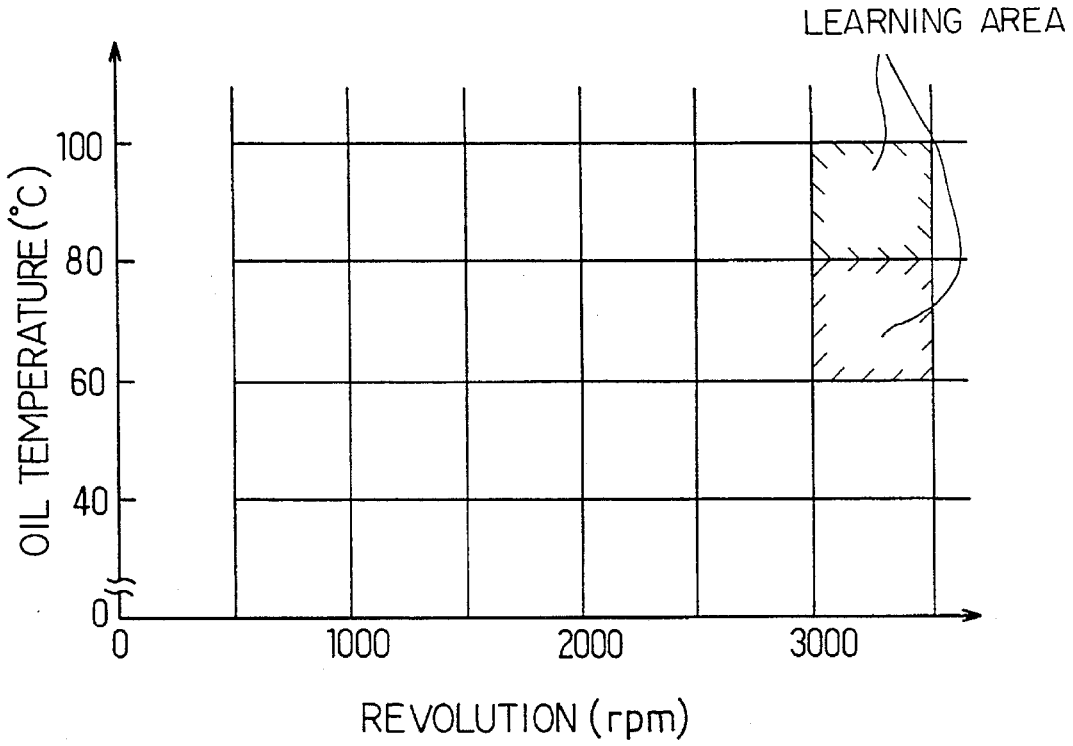
FIG. 14 is a graph showing how a learning area may be equally divided by a number of engine revolutions and oil temperature.

Although there has been only one learned value in the learning operation described above, it is more effective in terms of control to have a learned value per area divided according to the operating conditions (e.g., number of engine revolutions, oil temperature and water temperature). One possibility is to equally or evenly divide the whole operating area according to the oil temperature and number of engine revolutions and to have a learned value for each area as shown in FIG. 14.

Figure 15:
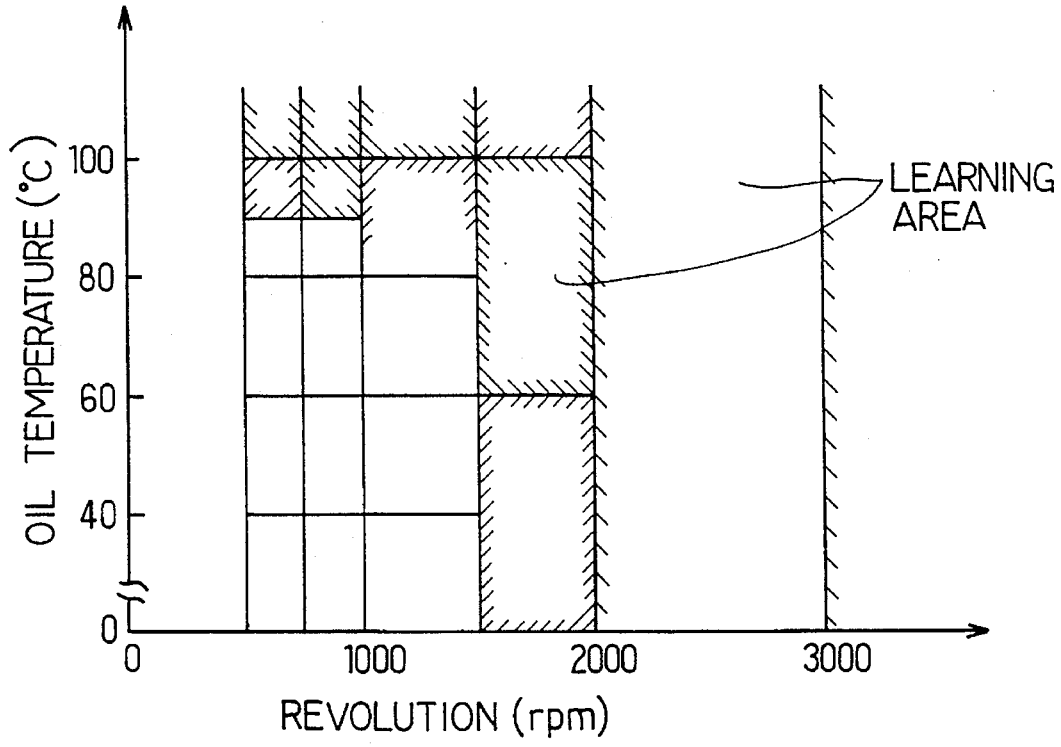
FIG. 15 is a graph showing how a learning area may be unevenly divided in accordance with a number of engine revolutions and oil temperature.

However, the actual holding duty value does not change unformly relative to the oil temperature and number of engine revolutions (see FIG. 9). Accordingly, improvement of the control accuracy and reduction of a dead program capacity can be accomplished by dividing the area unevenly in accordance with the changes of the holding duty value as shown in FIG. 15.

Figures 16A, 16B:
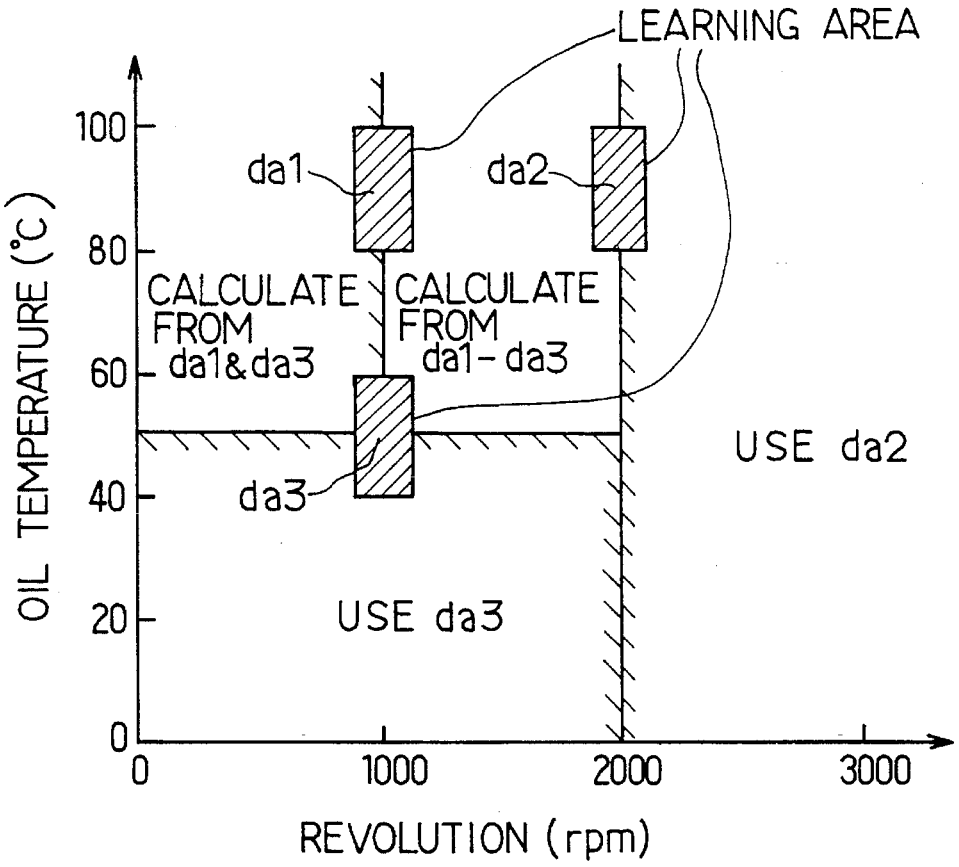
FIGS. 16*a* and 16*b* are graphs explaining an example in which a control value is learned only in n areas defined by the number of engine revolutions and oil temperature, where

Further, it is possible to have learned values in n specific operating areas, as shown in FIGS. 16*a* and 16b, and to correct the learned values of a plurality of areas among the n areas described above to use as holding duty value by using the parameters in operating condition in other areas. This method is advantageous in a state in which there are fewer learning opportunities, such as in the midst of change of the operating condition, since the learned values of the areas not learned are found by calculation. However, because they are merely found by calculation, the control accuracy (i.e., the difference between the target value and the advance value) is relatively low as compared to the learning of a correct value.

Figure 17:
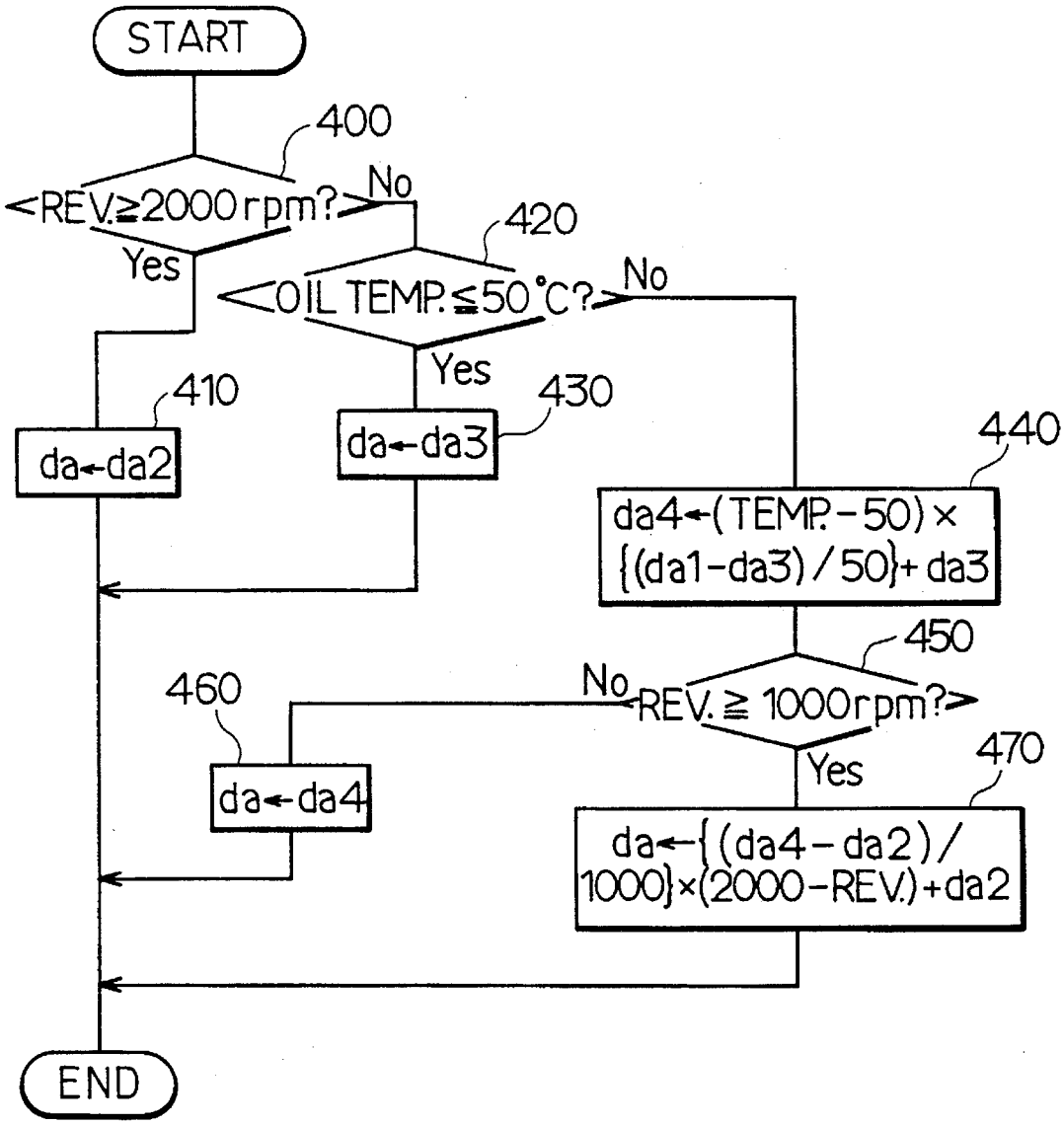
FIG. 17 is a flowchart showing an example of control in which the control value is learned only in n areas defined by the number of engine revolutions and oil temperature.

Finding the learned value by means of this method will be explained below with reference to a flowchart shown in FIG. 17. At first, it is determined in Step 400 whether a number of revolutions is more than 2000 rpm or not. If the number of revolutions≦2000 rpm, the process advances to Step 410 to adopt the value da2 learned in the area 2 in FIG. 12 as a holding duty value da.

If the number of revolutions<2000 rpm on the other hand, the process advances to Step 420 to determine whether the oil temperature is less than 50° C. or not. If the oil temperature≦50° C., the process advances to Step 430 to adopt the control value da3 learned in the area 3 in FIG. 16*a* as a holding duty value da. If the oil temperature>50° C. on the other hand, the process advances to Step 440 to calculate a tentative value da4 by the following equation:

$$da\ 4=(\text{oil temperature}-50)\times(da1-da3)/50+da$$

After that, the process advances to Step 450 to determine whether the number of revolutions is more than 1000 rpm or not. If the number of revolutions≦1000 rpm, the process advances to Step 460 to adopt the tentative value da4 calculated in the above-mentioned step 440 as a holding duty value da. If the number of revolutions>1000 rpm on the other hand, the process advances to Step 470 to calculate the holding duty value da according to the following equation:

$$da=\{(da4-da2)/1000\}\times(2000-\text{revolutions})+da2$$

It is to be noted that the following two methods are effective to prevent erroneous learning. The first method is to change by 1/m (where m is a constant) of a difference with the previous learned value as in the following equation, and not replacing the value with a newly learned value.

$$\text{new learned value (\%)}=\text{previous learned value (\%)}+\{(\text{control value (\%) learned this time}-\text{previous learned value (\%)})\}/m$$

Figure 19:
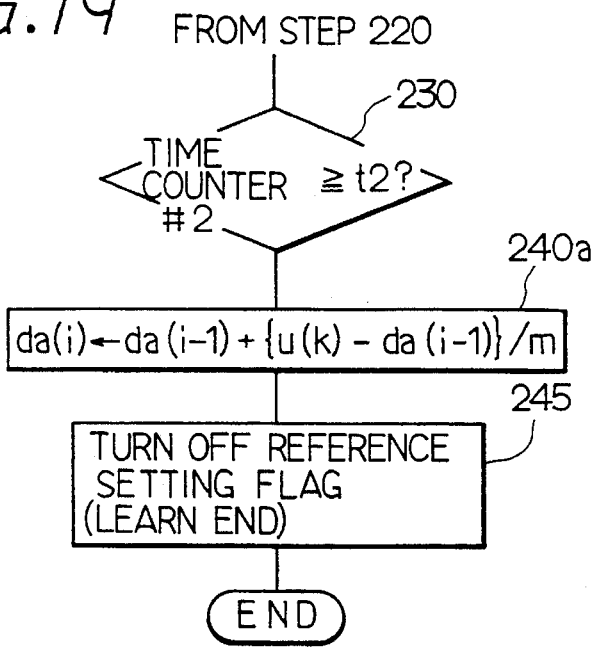
FIG. 19 is a flowchart showing a second example of a method for updating the learned value in the preferred embodiment.

This may be implemented by replacing the process of Step 240 in each of the learning operations shown in FIGS. 8, 12 and 13 with a process as shown in Step 240*a* of FIG. 19. That is, a value obtained by adding 1/m of a difference between the previous learned value da(i–1) and the value learned this time to the previous value da(i–1) is adopted as a new learned value da(i), and not adopting the newly learned value u(k) as the learned value as it is in updating the learned value.

The second method for preventing erroneous learning is to set up a limit to a quantity of change of a learned value which can be performed in one learning process. For example, if a maximum value of one time of quantity of change is L (%), the limit may be expressed as follows:

$$\text{previous learned value}+L\ (5)\leqq\text{new learned value (\%)}\leqq\text{previous learned value}-L\ (\%)$$

Figure 20:
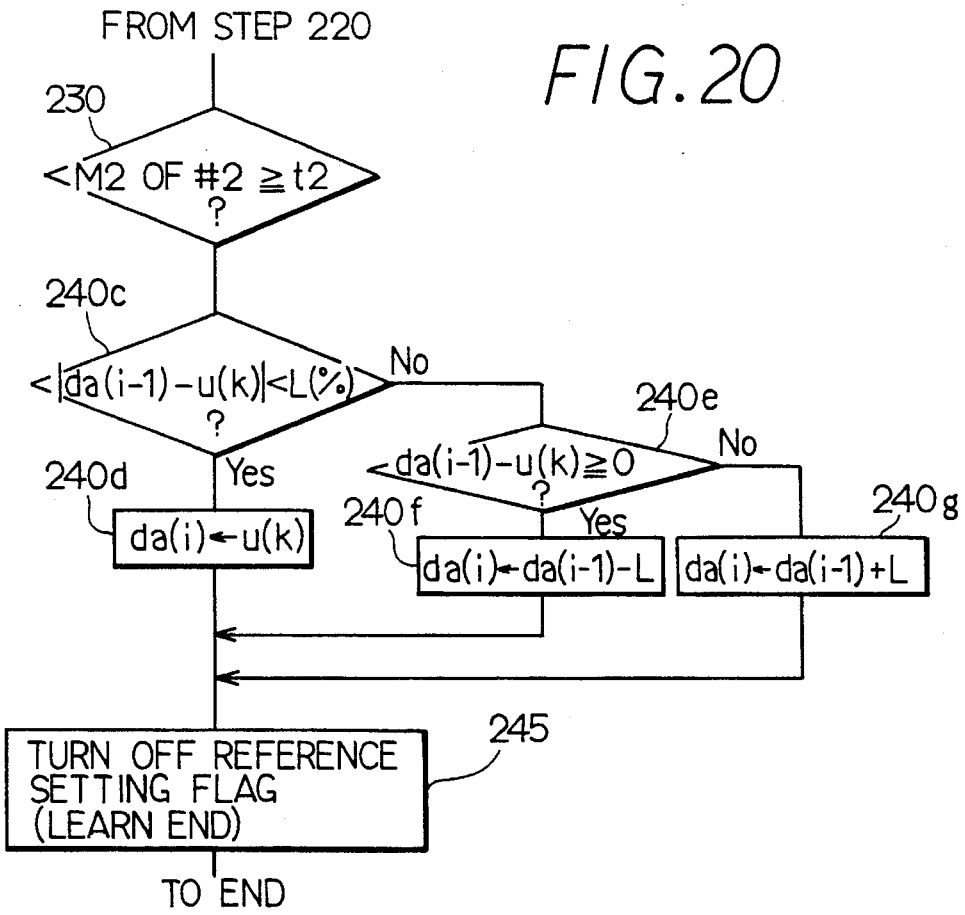
FIG. 20 is a flowchart showing a third example of the method for updating the learned value in the preferred embodiment.

This may be embodied by replacing the process in Step 240 in each of the learning operations shown in FIGS. 8, 12 and 13 with the processes in Steps 240*c* through 240*g* shown in FIG. 20. In these processes, it is determined at first in Step 240*c* whether an absolute value of a difference between the previous learned value da(i–1) and the newly learned value u(k) is smaller than the maximum quantity of change of the learned value L or not. If it is smaller, the process advances to Step 240d to use the newly learned value u(k) as a learned value da(i) of the current process. On the other hand, if the absolute value of the difference between the previously learned value da(i–1) and the learned value da(i) of the current process is more than the maximum quantity of change L, the process advances to Step 240*e* to determine whether da(i–1)–u(k) is greater than zero or not, i.e. a relative magnitude of da(i–1) and u(k). When da(i–1)–u(k) is greater than zero, the process advances to Step 240*f* to use a value obtained by subtracting the maximum quantity of change L from the previously learned value da(i–1) as the learned value da(i) of the current session. On the other hand, when a value of da(i–1)–u(k) is negative, the process advances to Step 240*g* to calculate da(i–1)+L to use the calculated value as the learned value da(i) of the current process.

FIGS. 21*a* through 24*a* show examples of experiments in which the camshaft advance value is set at the target value using the valve operation timing control apparatus (e.g., one which carries out the learning control shown in FIG. 8).

Figure 21A:
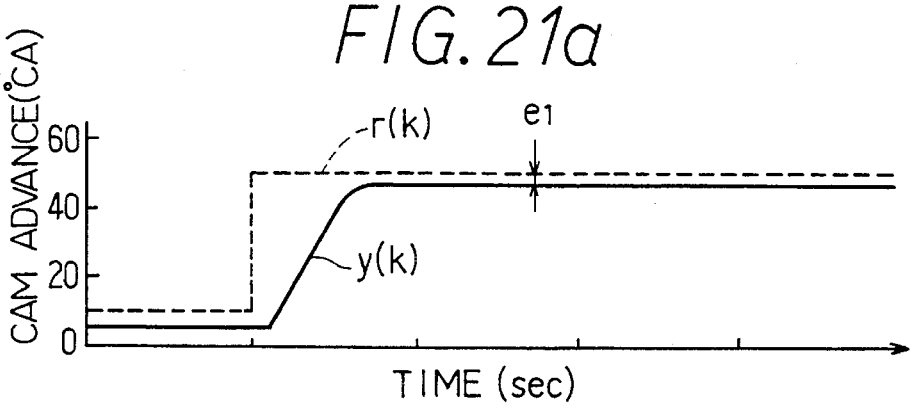
FIGS. 21*a* and 21*b* are time charts illustrating operation of the system when valve operation timing is controlled without carrying out the learning operation in the control apparatus in FIG. 3, where
Figure 21B:
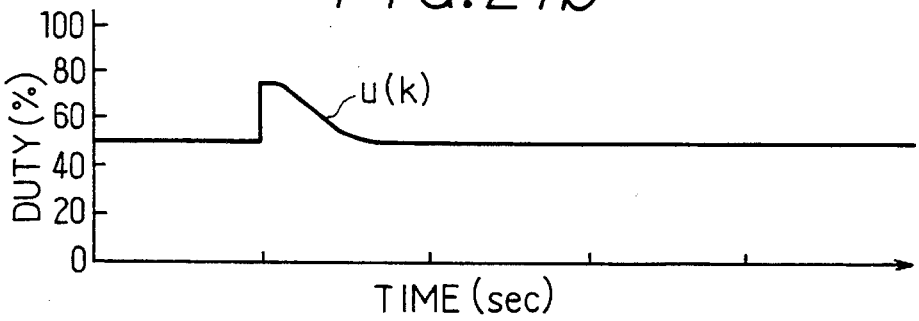
Figure 22A:
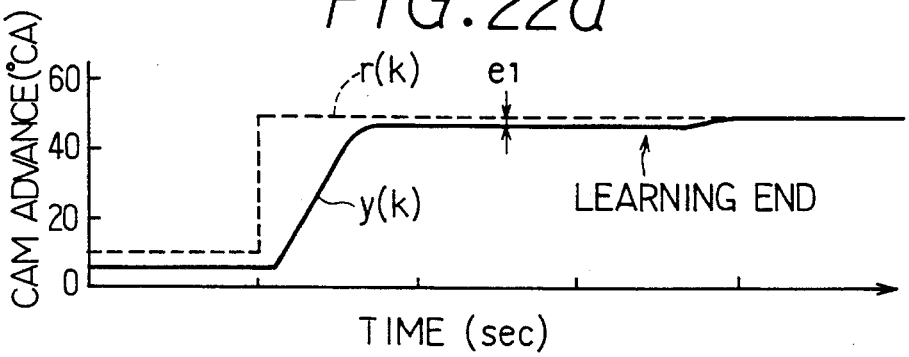
FIGS. 22*a* and 22*b* are time charts illustrating operation of the system when valve operation timing is controlled while carrying out the learning operation in the control apparatus in FIG. 3, where
Figure 22B:
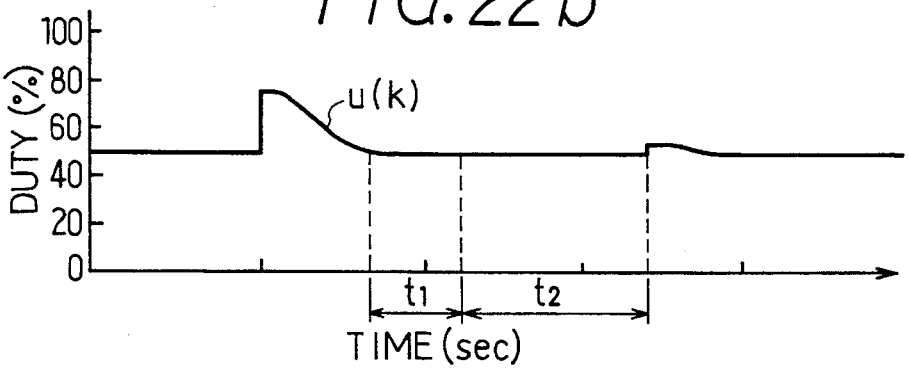
Figure 23A:
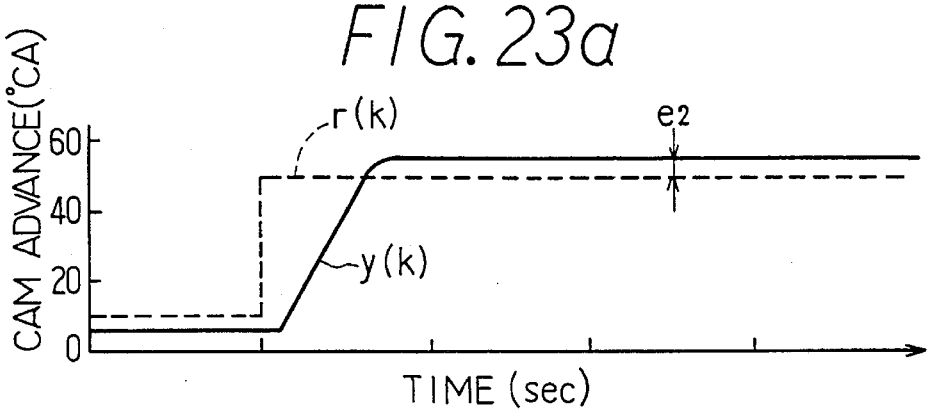
FIGS. 23*a* and 23*b* are time charts showing operation of the system when valve operation timing is controlled without carrying out the learning operation in the control apparatus in FIG. 3, where
Figure 23B:
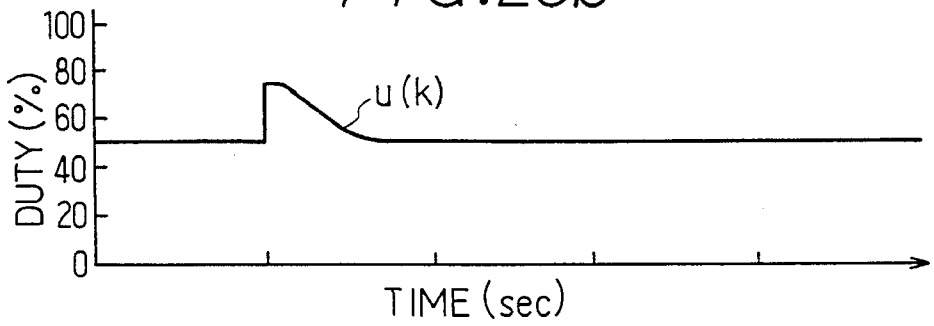
Figure 24A:
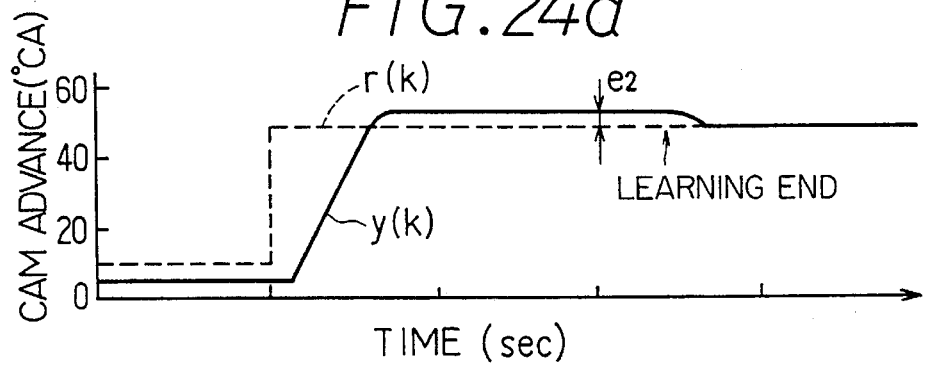
FIGS. 24*a* and 24*b* are time charts showing operation of the system when valve operation timing is controlled while carrying out the learning operation in the control apparatus in FIG. 3, where

Each figure shows an example in which a state in which the holding duty value da deviates from its true value, where FIGS. 21*a* and 22*a* show cases where it deviates below the true value and FIGS. 23*a* and 24*a* show cases where it deviates above the true value. FIGS. 21*a* and 23*a* also show cases where control is made without learning the holding duty value da, and FIGS. 22*a* and 24*a* show cases where control is performed while learning the holding duty value da. It is to be noted that each of FIGS. 21*a*, 22*a*, 23*a* and 24*a* shows a transition of the camshaft advance value using learning control and each of FIGS. 21*b* , 22*b*, 23*b* and 24*b* shows a transition of the duty value using learning control.

In FIGS. 21*b* and 22*b*, although an actual holding duty value da of the spool valve 53 is about 51%, it is set at about 48% initially by simulation in the experiment.

When the control is made without performing the learning operation in FIG. 21*a*, while the actual camshaft advance position y(k) approaches the target value r(k) as time passes, it converges to a constant value leaving a stationary deviation $e_1$.

On the other hand, when control is performed while performing the learning operation as shown in FIG. 22*a*, although the camshaft advance position y(k) converges on the constant value, leaving the stationary deviation $e_1$ in the beginning, similar to the case where no learning operation is carried out, the learning operation is started at a point of time when the target value r(k) and camshaft advance position y(k) continue for a certain predetermined time $t_1$ (or three pulses of time of the camshaft sensor signals). After that, when the camshaft advance position y(k) continues to be in the fixed state for a predetermined time $t_2$ (e.g. 100 ms), the camshaft advance position y(k) quickly reaches the target value r(k) as the holding duty value da is updated.

Figure 24B:
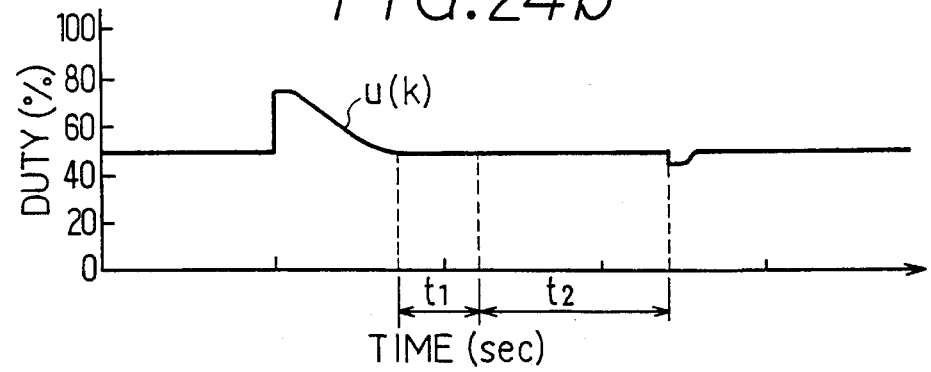

In FIGS. 23*b* and 24*b*, although the actual holding duty value da of the spool valve 53 is about 51%, it is deviated to about 54% by simulation initially in the experiment. When control is performed without carrying out the learning operation in FIG. 23*a*, the camshaft advance position y(k) approaches the target value r(k) as time passes and then converges with an overshoot $e_2$.

When control is performed while carrying out the learning operation as shown in FIG. 24*a*, learning is carried out similar to the case in FIG. 22*a* and the camshaft advance position y(k) quickly converges to the target value r(k) as the holding duty value da is updated.

The valve operation timing control apparatus permits the system to obtain the holding duty value from an output of the controller by using a controller having no integral operations as described above, and thereby permits the system to quickly compensate disturbances due to a fluctuation of operation of the spool valve and to eliminate the stationary deviation in the control thereafter.

It is to be noted that although the control value has been learned when both of the actual phase difference angle and the target value become almost constant for the predetermined time, it is possible to arrange the system so that the learning opportunity is determined based only on the actual phase difference angle, regardless of the target value, i.e., so that the controlled value is learned when the actual phase difference angle becomes almost constant for the predetermined time.

The present invention described above and constructed as described provides the following advantages.

A controlled value is learned when the actual phase difference angle becomes almost constant for the predetermined time and a controlled value thereafter is found based on the learned value, so that learning which corresponds to the change speed of the actual phase difference angle may be carried out and valve operation timing can be controlled following changes in operating conditions without reducing the learning frequency.

The controlled value is learned when both of the actual phase difference angle and the target value become almost constant for the predetermined time, so that it becomes possible to reflect the stability of the target value in addition to the actual phase difference angle in the learning, thereby allowing the system to avoid erroneous learning and to improve the accuracy of learning control further.

The operating conditions are also learned at the same time as learning the control value, and a learned value of the controlled value is corrected in accordance with changes in operating conditions when the operating conditions change, so that it permits the system to perform learning control following the changes in operating condition, thereby contributing to the improvement of the accuracy of the learning control.

The predetermined time for determining whether the actual phase difference angle or the actual phase difference angle and the target value have converged almost to a constant value or not is set at a time of n pulses of pulse signals used in calculating the actual phase difference angle or at a time obtained by adding a certain time to this time of n pulses, so that it permits the system to deal with the increase and decrease of camshaft position detecting signals due to the changes of the number of engine revolutions, thus contributing to the improvement of the accuracy of the learning control also from this aspect.

An average value of the controlled values or a value obtained by smoothing the controlled values is learned, so that a learning which is hardly influenced by a dispersion of signals or the like may be carried out, again improving the reliability of the learning control.

The controlled value corresponding to each area divided by the number of engine revolutions, an oil temperature or water temperature is learned, so that detailed learning control may be carried out per the number of engine revolutions, oil temperature or water temperature, again contributing to the improvement of the accuracy of the learning control.

The controlled value only in n areas defined by the number of engine revolutions, oil temperature or water temperature is learned and other areas are used by correcting the learned value by the quantities of operating condition, so that the learned values of the areas not learned may be found by calculation and an effect of learning may be obtained even in a state in which there are fewer learning opportunities such as in the midst of change of the operating conditions.

The learning is inhibited and a previously learned value is used by correcting it immediately after start-up or when an oil temperature or water temperature is less than a predetermined temperature when the learned value is not corrected by the oil temperature, so that the system can avoid low accuracy learning when the number of engine revolutions is unstable, again improving the reliability of the learning control.

A newly learned value is not used as a learned value as is in updating the learned value; instead, a value obtained by adding 1/m of a difference between a previously learned value and a value learned in the current process to the previous value is used as a new learned value, so that the system can avoid erroneous learning, further improving the reliability of the learning control.

A limit to a quantity of change of the learned value made in one time of learning is set up, so that it also permits the system to avoid erroneous learning, further improving the reliability of the learning control.

While preferred embodiments have been described, variations thereto will occur to those skilled in the art within the scope of the present inventive concepts which are delineated by the following claims.

What is claimed is:

1. An engine valve operation timing control apparatus, comprising:

a phase control mechanism, provided within a path for transmitting rotations from a crankshaft to a camshaft within an engine, for varying a rotational phase difference between the shafts;

driving means for driving said phase control mechanism;

operating condition detecting means for detecting a plurality of operating conditions representing operating conditions of said engine;

rotational phase difference detecting means for finding an actual phase difference angle between said shafts based on the operating conditions detected by said operating condition detecting means;

target value deciding means for deciding a target value of the rotational phase difference based on the operating conditions detected by the operating condition detecting means; and control means for generating a control value for causing said actual phase difference angle to coincide with said target value of the rotational phase difference and for outputting said control value to said driving means;

wherein said control means includes first determining means for determining whether said actual phase difference angle is almost constant for a predetermined time, learning means for learning said control value when said actual phase difference angle becomes almost constant for the predetermined time, and a controller for finding a control value thereafter based on the learned value.

2. The engine valve operation timing control apparatus according to claim 1, wherein said control means further comprises:

second determining means for determining whether said target value is almost constant for a predetermined time and causing said learning means to learn said control value when both of said actual phase difference angle and said target value become almost constant for the predetermined time.

3. The engine valve operation timing control apparatus according to claim 1, wherein:

said learning means learns the operating conditions detected by said operating condition detecting means when learning said control value; and said control means corrects a learned value of said control value in accordance with changes of said operating conditions when said operating conditions change.

4. The engine valve operation timing control apparatus according to claim 1, wherein said predetermined time for determining whether one of: a) said actual phase difference angle, and b) said actual phase difference angle and said target value, have converged almost to a constant value is set at a time of a predetermined number of pulses of pulse signals used in calculating said actual phase difference angle or at a time obtained by adding a certain time to this time of a predetermined number of pulses.

5. The engine valve operation timing control apparatus according to claim 1, wherein said learning means learns an average value of control values or a value obtained by smoothing the control values.

6. The engine valve operation timing control apparatus according to claim 1, wherein said learning means learns said control value based on an area of an operational range divided according to at least one of a number of engine revolutions, oil temperature and water temperature.

7. The engine valve operation timing control apparatus according to claim 1, wherein said learning means learns said control value only in a predetermined number of areas defined by at least one of a number of engine revolutions, oil temperature and water temperature, and uses other areas by correcting the learned value by the operating conditions detected by said operating condition detecting means.

8. The engine valve operation timing control apparatus according to claim 1, wherein said control means inhibits the learning by said learning means and corrects and uses a previously learned value immediately at least one of: a) after a start-up, and b) when at least one of an oil temperature and water temperature is less than a predetermined temperature, when the learned value is not corrected by the temperature.

9. The engine valve operation timing control apparatus according to claim 1, wherein said learning means does not use a newly learned value as a learned value as is in updating the learned value, but uses a value obtained by adding a predetermined portion of a difference between a previously learned value and a value learned in a current process to the previously learned value as a newly learned value.

10. The engine valve operation timing control apparatus according to claim 1, wherein a quantity of change of the learned value made in one time of learning is limited.

* * * * *